US005584670A

United States Patent [19]

Kawaguchi et al.

[11] Patent Number: 5,584,670

[45] Date of Patent: Dec. 17, 1996

[54] PISTON TYPE VARIABLE DISPLACEMENT COMPRESSOR

[75] Inventors: Masahiro Kawaguchi; Masanori Sonobe; Ken Suitou; Tomohiko Yokono, all of Kariya, Japan

[73] Assignee: Kabushiki Kaisha Toyoda Jidoshokki Seisakusho, Kariya, Japan

[21] Appl. No.: 421,215

[22] Filed: Apr. 13, 1995

Related U.S. Application Data

[63] Continuation-in-part of Ser. No. 255,043, Jun. 7, 1994, and a continuation-in-part of Ser. No. 361,111, Dec. 21, 1994.

[30] Foreign Application Priority Data

Apr. 15, 1994 [JP] Japan ..... 6-077610

[51] Int. Cl.[6] ..... F04B 1/29

[52] U.S. Cl. ..... 417/222.2; 417/295

[58] Field of Search ..... 417/222.2, 295, 417/222.1, 269

[56] References Cited

U.S. PATENT DOCUMENTS

| | | | |
|---|---|---|---|
| 4,669,272 | 6/1987 | Kawai et al. | 417/270 |
| 4,691,526 | 9/1987 | Kobayashi et al. | 417/269 |
| 4,801,248 | 1/1989 | Tojo et al. | 417/222.2 |
| 4,963,074 | 10/1990 | Sanuki et al. | 417/270 |
| 5,000,666 | 3/1991 | Esaki | 417/222.2 |
| 5,032,060 | 7/1991 | Kobayashi et al. | 417/222.1 |
| 5,173,032 | 12/1992 | Taquchi et al. | 417/222.2 |
| 5,259,736 | 11/1993 | Terauchi | 417/270 |
| 5,370,503 | 12/1994 | Terauchi | 417/270 |

FOREIGN PATENT DOCUMENTS

| | | | |
|---|---|---|---|
| 62-674 | 1/1987 | Japan | 417/222.2 |
| 64-56972 | 3/1989 | Japan | 417/222.2 |
| 2-115576 | 4/1990 | Japan | 417/222.2 |
| 3-160162 | 7/1991 | Japan | 417/222.2 |

*Primary Examiner*—Timothy Thorpe
*Assistant Examiner*—Peter G. Korytnyk
*Attorney, Agent, or Firm*—Brooks Haidt Haffner & Delahunty

[57] ABSTRACT

A swash plate type compressor is connected with an external refrigerant gas circuit. A device accommodated in the compressor disconnects the external circuit with the suction chamber when the swash plate is at the minimum inclining angle. A pressure decreasing passage creates the connection between the crank chamber and the suction chamber to decrease the pressure in the crank chamber. This passage releases the pressure in the crank chamber to the suction chamber when the pressure in the crank chamber is greater than the pressure in the suction chamber so that the swash plate is inclined toward the maximum inclining angle. An adjusting device adjusts the pressure in the pressure decreasing passage so that the pressure decreasing passage is opened to a greater degree when the swash plate is at the maximum inclining angle than when the swash plate is between the maximum and minimum inclining angles.

19 Claims, 21 Drawing Sheets

PRESSURE
(kgt/cm²)
ENGINE SPEED
(rpm)
500
10
0
DUTY CYCLE
(%)
100
ON
OFF
TIME
$t_0$
$Pd_1$
$Ps_1$
$Ne_1$
$D_1$
$Sw_1$
$Pd_2$
$Ps_2$
$Ne_2$
$D_2$
$Sw_2$
$Pd_3$
$Ps_3$
$Ne_3$
$D_3$
$Sw_3$

PISTON TYPE VARIABLE DISPLACEMENT COMPRESSOR

This application is a continuation in part application of the U.S. application Ser. No. 08/255,043 filed on Jun. 7, 1994, entitled SWASH PLATE TYPE COMPRESSOR, and of U.S. application Ser. No. 08/361,111 filed on Dec. 21, 1994, both of which are incorporated herein by reference.

BACKGROUND OF THE INVENTION

1. Field of the Invention

The present invention relates to a piston type variable displacement compressor. More specifically, this invention relates to a piston type variable displacement compressor capable of efficiently adjusting the pressure in the crank chamber.

2. Description of the Related Art

In general, compressors are mounted in vehicles to supply compressed refrigerant gas to the vehicle's air conditioning system. To maintain air temperature inside the vehicle at a level comfortable for the vehicle's passengers, it is important to utilize a compressor whose displacement is controllable. One known compressor of this type controls the inclined angle of a swash plate, tiltably supported on a drive shaft, based on the difference between the pressure in a crank chamber and the suction pressure, and converts the rotational motion of the swash plate to the reciprocal linear motion of each piston.

A conventional piston type compressor disclosed in U.S. Pat. No. 5,173,032 uses no electromagnetic clutch for the transmission and blocking of power between an external driving source and the drive shaft of the compressor. The external driving source is coupled directly to the drive shaft.

The clutchless structure with the driving source coupled directly to the drive shaft can eliminate shocks which otherwise may be produced by the ON/OFF action of such a clutch. When such a compressor is mounted in a vehicle, passenger comfort is improved. The clutchless structure can also contribute to reducing the overall weight and cost of the cooling system.

In such a clutchless system, the compressor runs even when no cooling is needed. With such compressors, it is important that when cooling is not needed, the discharge displacement be reduced as much as possible to prevent the evaporator from frosting. When no cooling is needed or there is a change of frosting, the circulation of the refrigerant gas through the compressor and its external refrigeration circuit should be stopped. The compressor described in the aforementioned U.S. patent is designed to block the flow of gas into the suction chamber from the external refrigeration circuit by the use of an electromagnetic valve.

In the compressor described above, when the circulation of the gas from the external refrigeration circuit to the suction chamber is blocked, the pressure in the suction chamber drops and the control valve responsive to that pressure opens fully. The full opening of the control valve allows the gas in the discharge chamber to flow into the crank chamber, which in turn raises the pressure inside the crank chamber. The gas in the crank chamber is then to the suction chamber. Accordingly, a short circulation path is formed which passes through the cylinder bores, the discharge chamber, the crank chamber, the suction chamber and back to the cylinder bores.

When the pressure in the suction chamber falls, the suction pressure in the cylinder bores falls, too, thus increasing the difference between the pressure in the crank chamber and the pressure in the cylinder bores. This pressure differential in turn minimizes the inclination of the swash plate which reciprocates the pistons. As a result, the discharge displacement is minimized. At this time, the driving torque needed by the compressor is minimized, thus reducing power loss as much as possible.

When the gas flow to the suction chamber from the external refrigeration circuit starts again, the pressure in the suction chamber rises, and then the control valve closes. This inhibits the gas flow into the crank chamber from the discharge chamber, lowering the pressure in the crank chamber. As in the pressure in the suction chamber rises, the suction pressure in the cylinder bores rises, too. The difference between the pressure in the crank chamber and the pressure in the cylinder bores therefore becomes smaller, and the inclined angle of the swash plate reaches a maximum, maximizing the discharge displacement. At this time, the torque needed to drive the compressor becomes maximum.

The aforementioned electromagnetic valve performs a simple ON/OFF action to instantaneously stop or restart the gas flow from the external refrigerant circuit into the suction chamber. Accordingly, the amount of gas supplied into the cylinder bores from the suction chamber decreases or increases drastically. This rapid change in the amount of gas flowing into the cylinder bores causes an abrupt change in the discharge displacement, rapidly decreasing or increasing the discharge pressure. Consequently, the driving torque needed to drive the compressor greatly changes over a short period of time.

When this type of compressor is mounted in a vehicle, one should consider the problem of engine stall. Engine stalling is caused by the torque necessary for driving accessories, such as an alternator or an oil pump for a powered steering mechanism, and the increasing torque needed to drive the compressor. To eliminate the causes of engine stall, an idle speed controller (hereinafter referred to as ISC) is used. The ISC adjusts the amount of air supplied to the engine during idle to keep the engine speed (hereinafter called idling engine speed) at a target value.

The ISC performs feedback control of an actuator, which adjusts the amount of air supplied to the engine to hold the actual engine speed to a target value. During idle, however, when the load of the compressor or the like drastically increases, the engine speed rapidly decreases. In this case, the feedback control of the ISC cannot follow the rapid change in cycle speed, causing the engine to stall. The compressor disclosed in the above-described U.S. patent does not suggest how to avoid engine stall caused by the increased torque needed to drive the compressor.

The target value of the idling engine speed for the case where the load of the compressor or the like is applied to the engine may be set higher than the target value where the load of the compressor or the like is not applied to the engine. With this scheme, even when the load of the compressor or the like on the engine increases drastically at the idling time, causing the rapid decrease in the engine speed, the engine speed is increased, thus avoiding engine stall. If the speed of the idling engine is increased, however, the fuel consumption of the vehicle is increased.

SUMMARY OF THE INVENTION

Accordingly, it is a primary objective of the present invention to provide a compressor capable of suppressing a drastic change in torque needed to drive the compressor.

It is another objective of this invention to provide a compressor which can ensure smooth lubrication.

A compressor in accordance with the present invention comprises a swash plate mounted on a drive shaft for integral rotation therewith in a crank chamber. A piston is coupled to the swash plate and located in a cylinder bore. The rotation of the drive shaft is converted to reciprocating movement of the piston to compress gas supplied to the cylinder bore from an external circuit by way of a suction chamber and to discharge the gas to a discharge chamber. The swash plate is tiltable between a maximum inclining angle and a minimum inclining angle with respect to the drive shaft according to the difference between pressures in the crank chamber and the suction chamber. The swash plate controls the displacement of the compressor to be a maximum when the swash plate is at the maximum inclining angle and to be a minimum when the swash plate is at the minimum inclining angle. The compressor further comprises a device for disconnecting the external circuit with the suction chamber when the swash plate is at the minimum inclining angle. A pressure decreasing passage means is providing for connecting the crank chamber and the suction chamber to decrease the pressure in the crank chamber. The passage means releases the pressure in the crank chamber to the suction chamber when the pressure in the crank chamber is greater than the pressure in the suction chamber such that the swash plate is inclined toward the maximum inclining angle. The compressor further comprises a device for adjusting the flow in the pressure decreasing passage means such that the pressure decreasing passage means is opened to a greater degree when the swash plate is at the maximum inclining angle than when the swash plate is between the maximum and minimum inclining angles.

BRIEF DESCRIPTION OF THE DRAWINGS

The features of the present invention that are believed to be novel are set forth with particularity in the appended claims. The invention, together with objects and advantages thereof, may best be understood by reference to the following description of the presently preferred embodiments together with the accompanying drawings in which:

FIG. 8(*c*) is a graph showing variations in the suction pressure, the discharge pressure, the engine speed, the excitation/de-excitation of the electromagnetic valve and the cycle of the duty signal in the ISC when the cross-sectional area of the passage varies;

FIG. 13(*b*) is in an enlarged cross-sectional view of a portion of the compressor of FIG. 13*a* with its swash plate at the minimum inclined angle;

DETAILED DESCRIPTION OF THE PREFERRED EMBODIMENT

Figure 1:
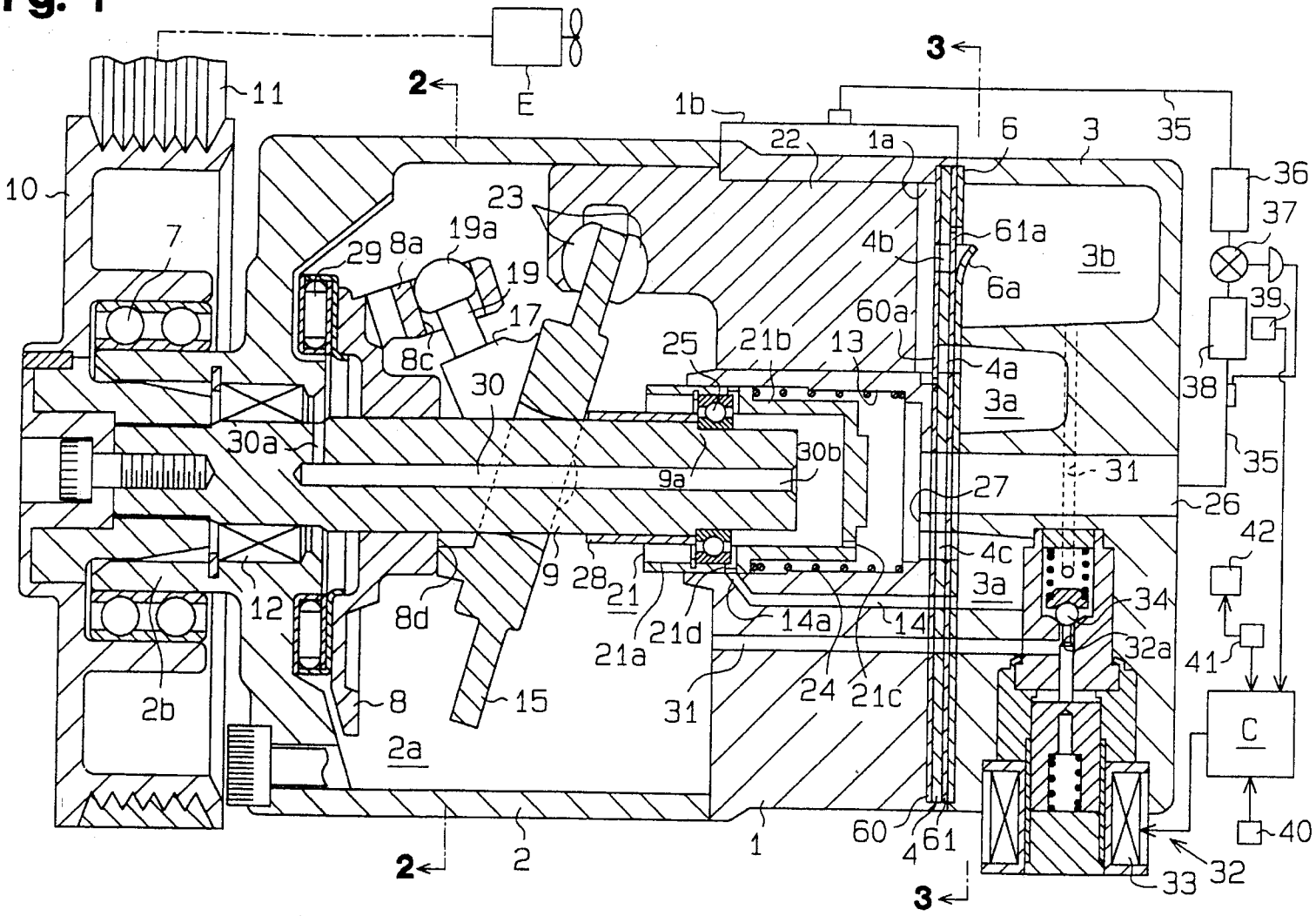
FIG. 1 is a side cross-sectional view of a compressor according to the first embodiment of the present invention.

A compressor according to a first embodiment of the present invention will now be described with reference to FIGS. 1 through 8. FIG. 1 presents a cross-sectional view showing the overall compressor. The outline of the compressor will be discussed with reference to FIG. 1. A cylinder block 1 constitutes a part of the housing of the compressor. A front housing 2 is secured to the front end of the cylinder block 1. A rear housing 3 is secured to the rear end of the cylinder block 1 via a first plate 4, a second plate 60, a third plate 61 and a fourth plate 6. The front housing 2 defines a crank chamber 2*a*. A drive shaft 9 is supported rotatably on the front housing 2 and the cylinder block 1. The front end of the drive shaft 9 protrudes outside the crank chamber 2*a*, with a pulley 10 secured to this front end. The pulley 10 is functionally coupled to the engine E of a vehicle via a belt 11.

A support pipe 2*b* protrudes from the front end of the front housing 2 in such a way as to surround the front end of the drive shaft 9. The pulley 10 is supported via an angular bearing 7 on the support pipe 2*b*. Through the angular bearing 7, support pipe 2*b* receives both the thrust load and radial load which act on the pulley 10. Between the front end of the drive shaft 9 and the front housing 2 is a lip seal 12 which prevents pressure leakage from the crank chamber 2*a*.

Figure 2:
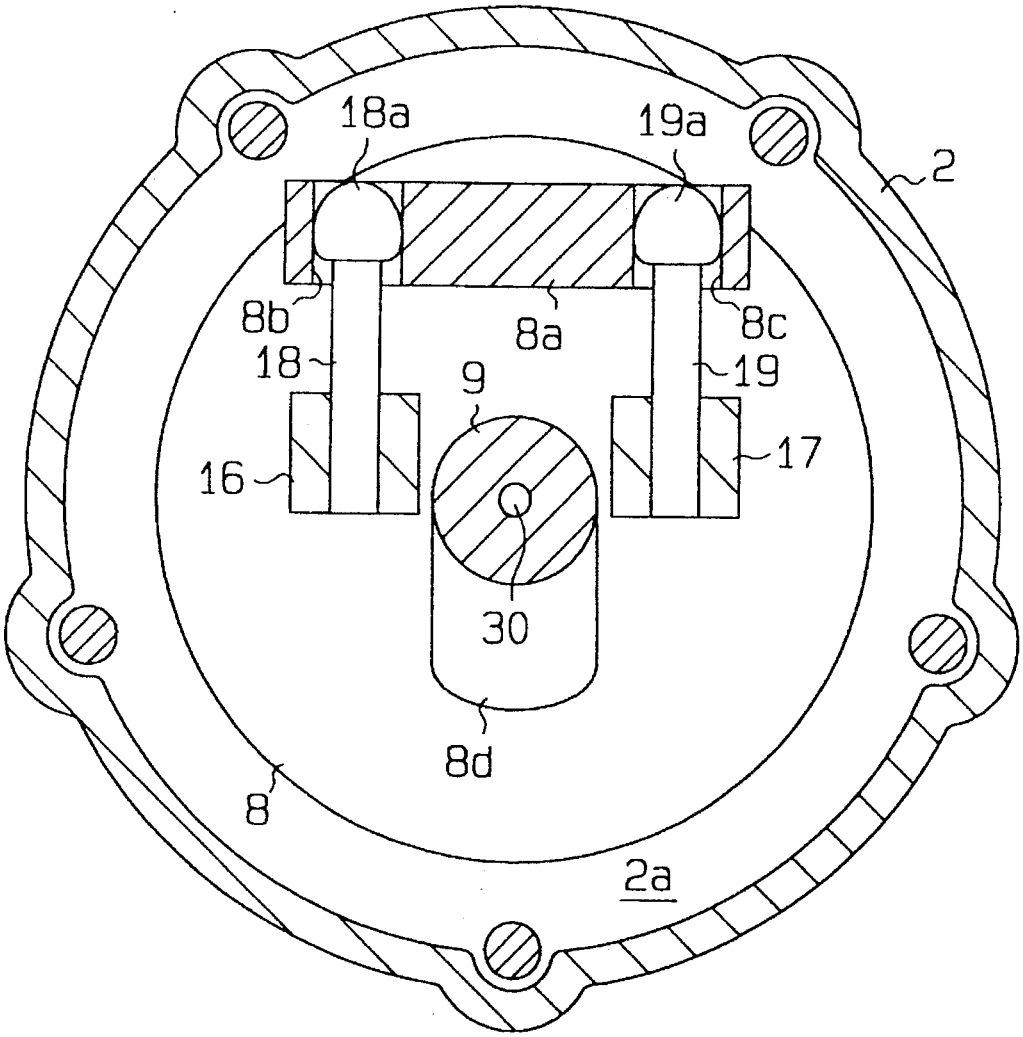
FIG. 2 is a cross-sectional view taken along the line 2—2 in FIG. 1.

A swash plate 15 is supported by the drive shaft 9 in such a way as to be slidable along and tiltable with respect to the axis of this shaft 9. As shown in FIGS. 1 and 2, a pair of stays 16 and 17 are secured to the swash plate 15, with guide pins 18 and 19 fixed to the respective stays 16 and 17. Guide balls 18*a* and 19*a* are formed at the distal ends of the respective guide pins 18 and 19. A drive plate 8 is fixed to the drive shaft 9. The drive plate 8 has a support arm 8*a* protruding toward the swash plate 15 (rearward) from the drive plate 8. A pair of guide holes 8*b* and 8*c* are formed in the arm 8*a*, and the guide balls 18*b* and 19*a* are slidably fitted in the associated guide holes 8*b* and 8*c*. The cooperation of the arm 8*a* and the guide pins 18 and 19 permits the swash plate 15 to rotate together with the drive shaft 9 and to tilt with respect to the drive shaft 9.

A plurality of cylinder bores 1*a* are formed in the cylinder block 1 in such a way as to communicate with the crank chamber 2*a*. A single-headed pistons 22 are retained in the associated cylinder bores 1*a*. The hemispherical portions of a pair of shoes 23 are fitted on each piston 22 in a mutually slidable manner. The swash plate 15 is held between the flat portions of both shoes 23. Accordingly, the undulation of the swash plate 15 caused by the rotation of the drive shaft 9 is transmitted via the shoes 23 to each piston 22, so that the piston 22 reciprocates in the associated cylinder bore 1*a* in accordance with the inclination of the swash plate 15.

Figure 3:
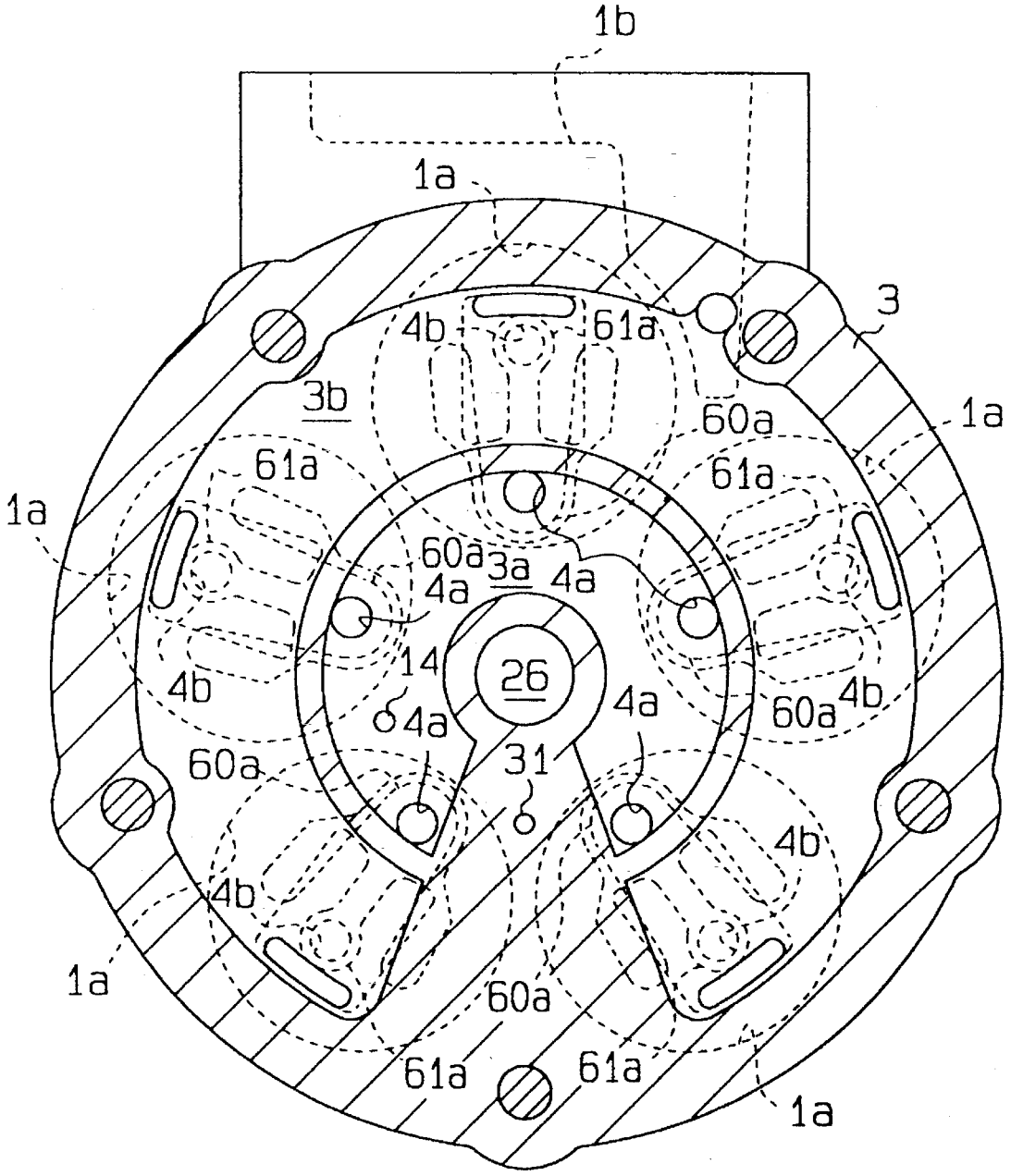
FIG. 3 is a cross-sectional view taken along the line 3—3 in FIG. 1.

As shown in FIGS. 1 and 3, a suction chamber 3*a* and a discharge chamber 3*b* are defined in the rear housing 3. Suction ports 4*a* and discharge ports 4*b* are formed in the first plate 4. Suction valves 60*a* are formed on the second plate 60, and discharge valves 61*a* are formed on the third plate 61. As the pistons 22 move backward, the refrigerant gas in the suction chamber 3*a* forces the suction valves 60*a* open through the suctions ports 4*a* and enters the cylinder bores 1*a*. As the pistons 22 move forward, the refrigerant gases in the cylinder bores 1*a* force the discharge valves 61*a* open through the discharge ports 4*b* and enter the discharge chamber 3*b*. As each discharge valve 61*a* abuts on a retainer 6*a* on the fourth plate 6, the amount of opening of the associated discharge valve 61*a* is restricted.

A thrust bearing 29 is placed between the drive plate 8 and the front housing 2. This thrust bearing 29 receives the compressive reaction force that acts on the drive plate 8 via the pistons 22, the swash plate 15, etc.

Figure 4:
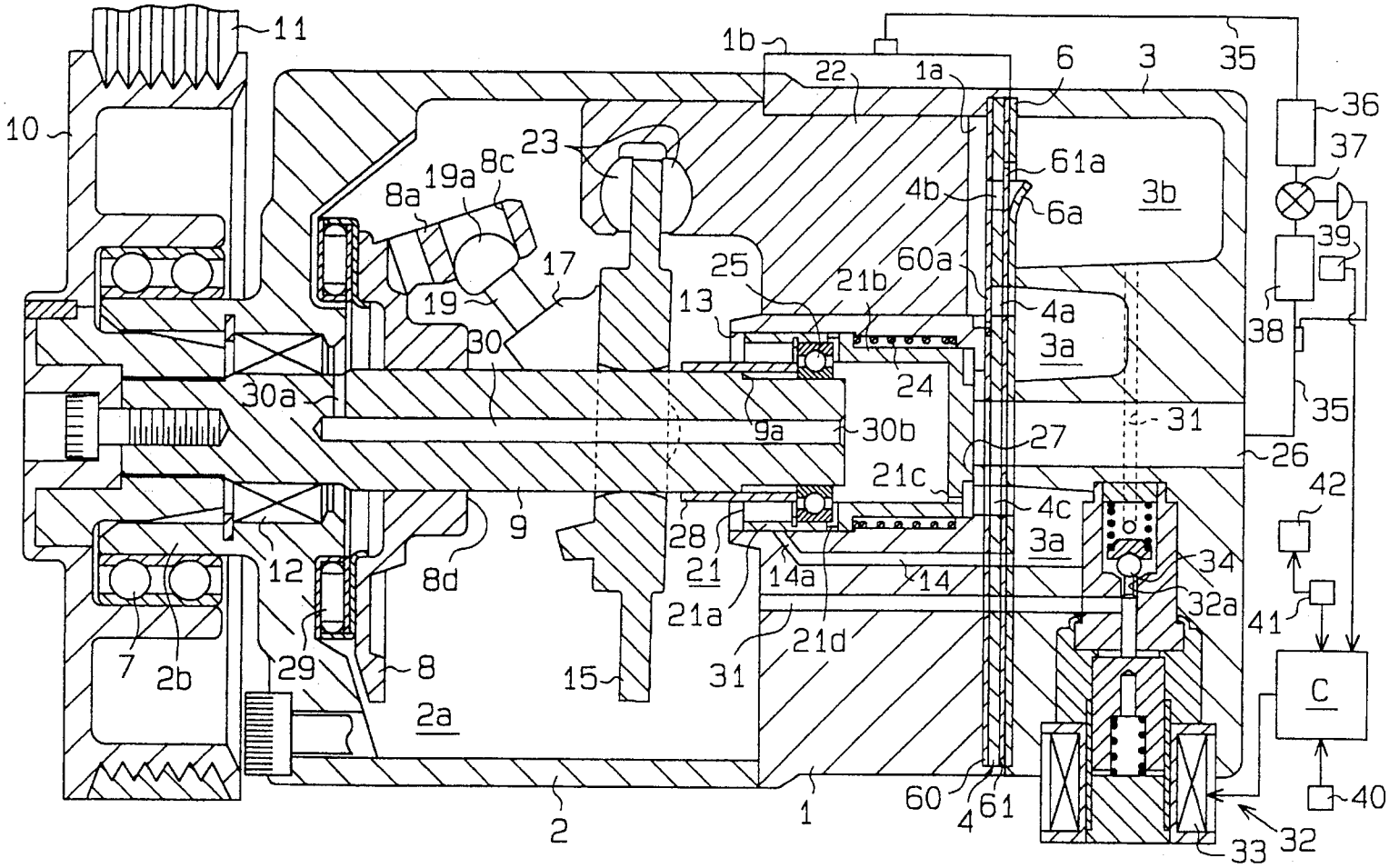
FIG. 4 is a side cross-sectional view of the compressor with its swash plate at a minimum inclined angle.
Figure 5:
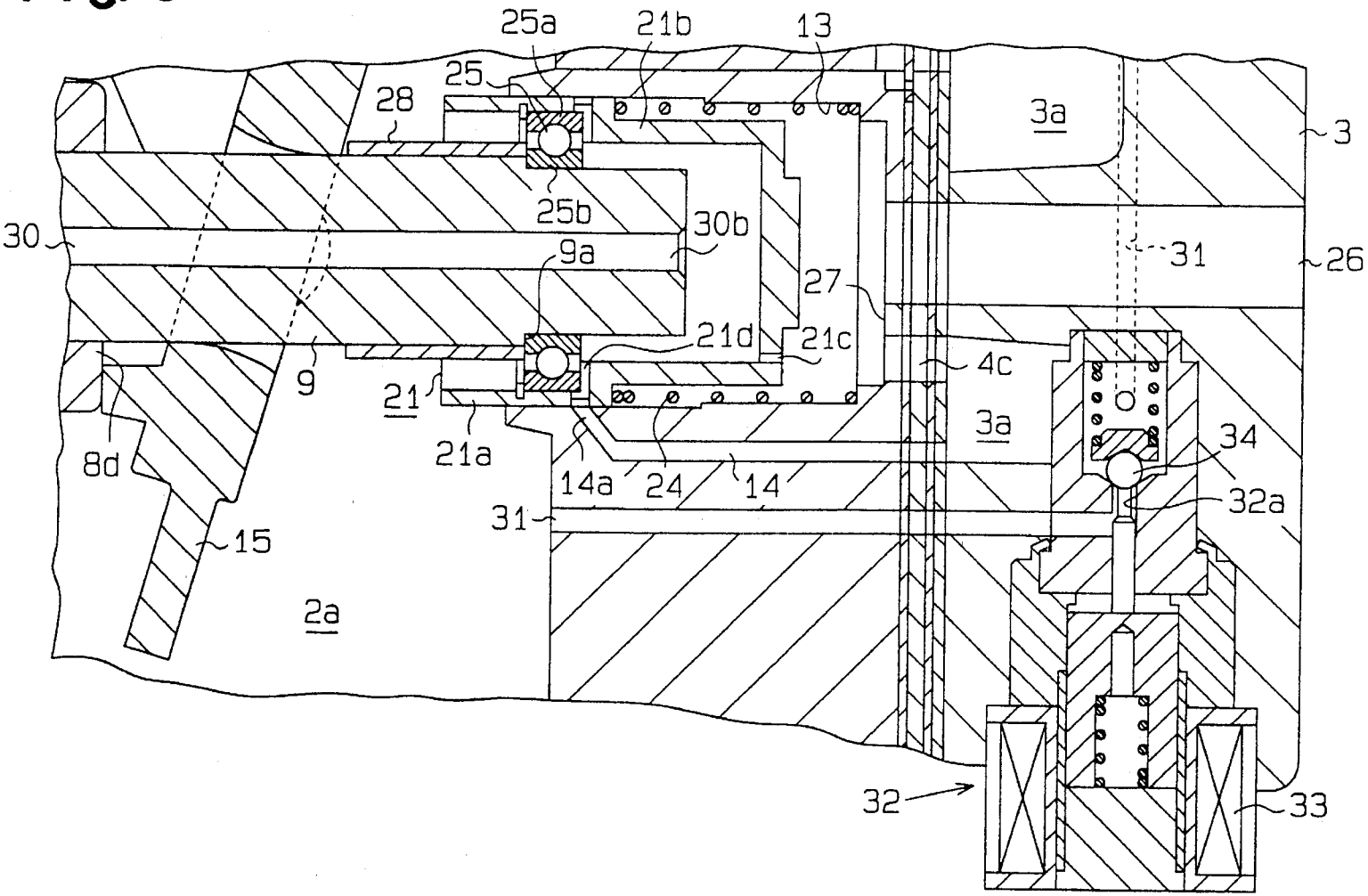
FIG. 5 is an enlarged cross-sectional view of a portion of the compressor of FIG. 1 with its swash plate at a maximum inclined angle.

As shown in FIGS. 1, 4 and 5, a shutter chamber 13 is formed in the center portion of the cylinder block 1, extending along the axis of the drive shaft 9. A cylindrical spool 21 having one closed end is slidably accommodated in the shutter chamber 13. The spool 21 has a large diameter portion 21*a* and a small diameter portion 21*b*. A spring 24 is located between the step portion between the large diameter portion 21*a* and small diameter portion 21*b* and the step portion of the inner wall of the shutter chamber 13. The spring 24 urges the spool 21 toward the swash plate 15.

The rear end of the drive shaft 9 is inserted in the spool 21. A ball bearing 25 is located between the rear end of the drive shaft 9 and the inner wall of the large diameter portion 21*a* of the spool 21. The ball bearing 25 receives loads in the radial direction and the thrust direction that are applied to the drive shaft 9. The rear end of the drive shaft 9 is supported by the inner wall of the shutter chamber 13 via the ball bearing 25 and the spool 21. The ball bearing 25 has an outer race 25*a* fixed to the inner wall of the large diameter portion 21*a* and an inner race 25*b* which is slidable along the outer surface of the drive shaft 9.

As shown in FIG. 5, a step portion 9*a* is formed on the rear outer surface of the drive shaft 9. The engagement of the inner race 25*b* of the ball bearing 25 and this step portion 9*a* inhibits the movement of the ball bearing 25 toward the swash plate 15 (frontward). At the same time, the engagement prohibits the spool 21 from moving toward the swash plate 15.

A suction passage 26 is formed in the center portion of the rear housing 3. This suction passage 26 communicates with the shutter chamber 13. A positioning surface 27 is formed on the cylinder block 1 between the shutter chamber 13 and the suction passage 26. The distal end of the spool 21 is abuttable on the positioning surface 27. As the distal end of the spool 21 abuts on the positioning surface 27, the movement of the spool 21 away from the swash plate 15 or in the rearward direction is restricted and the suction passage 26 is disconnected from the shutter chamber 13.

A pipe 28 is slidably attached to the drive shaft 9 between the swash plate 15 and the ball bearing 25. The front end of the pipe 28 is abuttable on the rear end face of the swash plate 15. The rear end of the pipe 28 does not contact the outer race 25*a* of the ball bearing 25 but contacts only the inner race 25*b*.

As the swash plate 15 moves rearward, it abuts on the pipe 28. The pipe 28 in turn pushes the inner race 25*b* of the ball bearing 25. As a result, the spool 21 moves toward the positioning surface 27 against the urging force of the spring 24 and the distal end of the spool 21 abuts on the positioning surface 27. At this time, the inclined angle of the swash plate 15 is restricted to be minimized. The minimum inclined angle of the swash plate 15 is slightly larger than zero degrees. An incline of zero degrees is defined as the incline of the swash plate 15 when the plane of the swash plate is perpendicular to the drive shaft 9.

Figure 6:
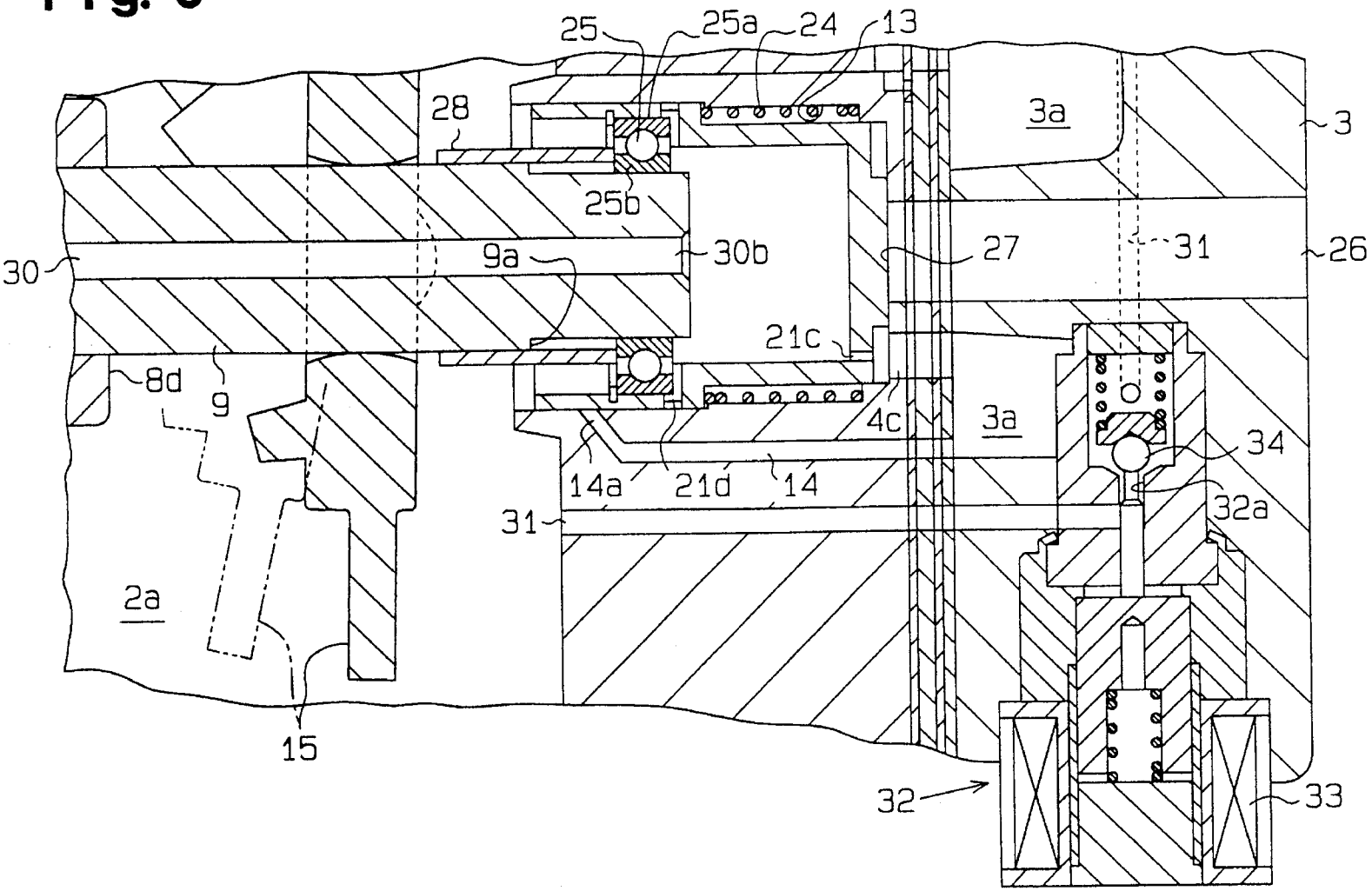
FIG. 6 is an enlarged cross-sectional view of a portion of the compressor of FIG. 1 with its swash plate at the minimum inclined angle.
Figure 7:
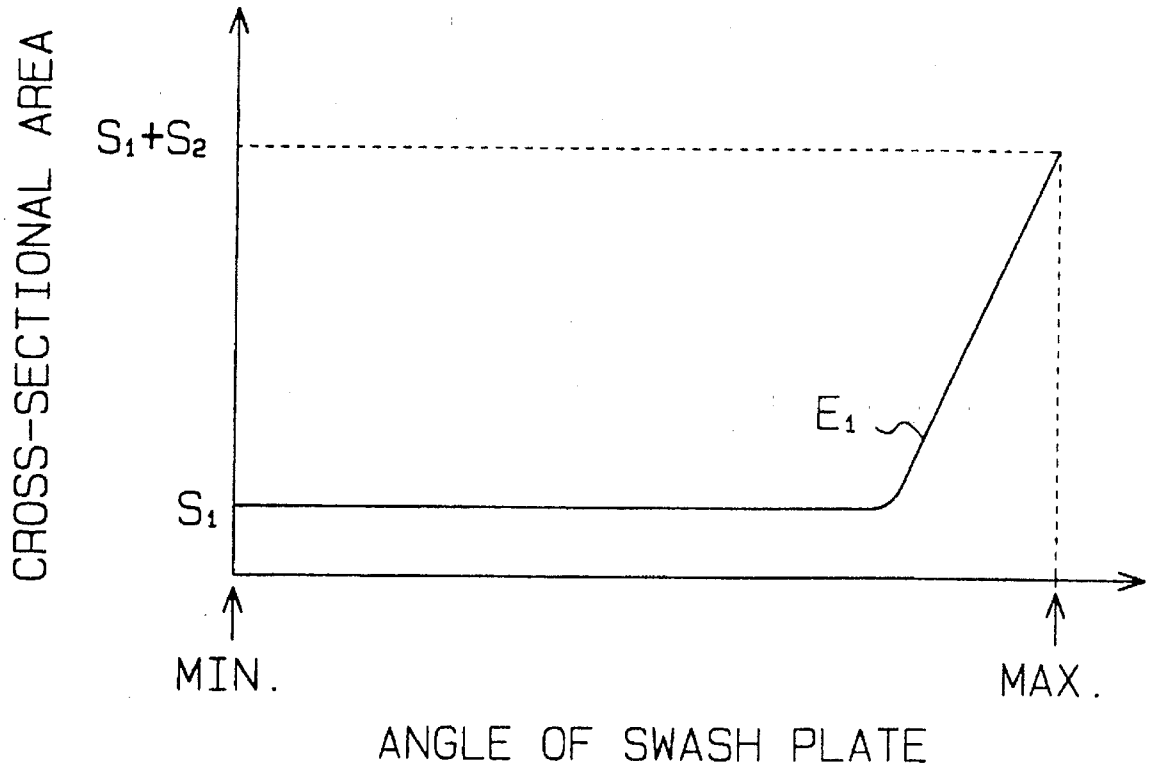
FIG. 7 is a graph indicating how the cross-sectional area of the passage running from the crank chamber to the suction chamber varies.

When the inclined angle of the swash plate 15 reaches the minimum, the spool 21 comes to a closed position to disconnect the suction passage 26 from the shutter chamber 13, as shown in FIG. 6. The spool 21 is movable between this closed position and an open position (see FIG. 5) spaced from the closed position, and is positioned in response to the movement of the swash plate 15. As shown in FIG. 1, abutting on a projection 8*d* of the drive plate 8, the swash plate 15 is prevented from inclining beyond a predetermined maximum inclined angle.

The suction chamber 3*a* communicates with the shutter chamber 13 via a communication hole 4*c* which passes through the individual plates 4, 60, 61 and 6. This communication hole 4*c* is blocked from the suction passage 26 when the spool 21 is in the closed position. The suction passage 26 forms an inlet to supply the refrigerant gas into the compressor. Therefore, the spool 21 blocks the passage of the refrigerant gas from the suction passage 26 to the suction chamber 3*a* downstream of that inlet.

As shown in FIG, 1, air axial passage 30 is formed in the drive shaft 9. The axial passage 30 has an inlet 30*a* open to the crank chamber 2a and an outlet 30b open inside the spool 21. As shown in FIGS. 1, 4 and 5, a through hole, or fixed flow controlling passage 21c is formed in the distal end of the spool 21. As shown in FIGS. 1 and 5, when the swash plate 15 is at the maximum inclined angle, the through hole 21c communicates with the interior of the spool 21. When the swash plate 15 is at the minimum inclined angle, the through hole 21c communicates with the interior of the spool 21, as shown in FIGS. 4 and 6. Accordingly, the crank chamber 2a always communicates with the suction chamber 3a via the passage 30, the interior of the spool 21, the through hole 21c and the communication hole 4c.

A variable flow controlling passage 14 is formed in the cylinder block 1. The variable flow controlling passage 14 has an inlet 14a open to the inner wall of the shutter chamber 13 and an outlet open to the suction chamber 3a. A connection passage 21d is formed in the outer surface and through the wall of the large diameter portion 21a of the spool 21.

As shown in FIGS. 1 and 5, with the maximum inclined angle of the swash plate 15, the connection passage 21d is connected to the inlet 14a of the variable passage 14. When the inclined angle of the swash plate 15 is in the range from the intermediate inclined angle indicated by the broken line in FIG. 6 to the minimum inclined angle indicated by the solid line, the connection passage 21d is blocked from the inlet 14a. As a result, when the swash plate 15 is near its maximum inclined angle, the crank chamber 2a communicates with the suction chamber 3a via the through hole 21c as well as via the connection passage 21d and the variable passage 14. On the other hand, when the swash plate 15 is positioned in the range from the intermediate inclined angle to the minimum inclined angle, the crank chamber 2a communicates with the suction chamber 3a via the through hole 21c alone. Therefore, the variable flow controlling passage 14 has a valved part, and the cross-sectional area of the valved part changes in accordance with the inclined angle of the swash plate 15.

Thus, the axial passage 30, the connection passage 21d, the through hole 21c, the communication hole 4c, and the variable flow controlling passage 14

As shown in FIGS. 1 and 4, a supply passage 31 connects the discharge chamber 3b to the crank chamber 2a. An electromagnetic valve 32 is attached to the rear housing 3 and is located midway in the supply passage 31. When the solenoid 33 of the electromagnetic valve 32 is energized, a valve body 34 closes a valve hole 32a as shown in FIG. 1. When the solenoid 33 is de-energized, the valve body 34 opens the valve hole 32a as shown in FIG. 4. Therefore, the electromagnetic valve 32 selectively opens or closes the supply passage 31 between the discharge chamber 3b and the crank chamber 2a.

The cross-sectional area $S_1$ of the through hole 21c is smaller than the cross-sectional area $S_2$ of the inlet 14a of the passage 14. The cross-sectional area $S_2$ is smaller than the cross-sectional area of the passage 30. The sum of the cross-sectional areas of the through hole 21c and the inlet 14a, $(S_1+S_2)$, is set to a value which permits the swash plate 15 to be stably held at the maximum inclined angle. The cross-sectional area $S_1$ is set to a value which permits the swash plate 15 to be stably held at the minimum inclined angle when the supply passage 31 is open. A curve $E_1$ of the graph in FIG. 7 indicates how the cross-sectional area of the pressure decreasing passage means connecting the crank chamber 2a to the suction chamber 3a varies in accordance with the inclined angle of the swash plate 15.

An external refrigeration circuit 35 connects the suction passage 26 for supplying the refrigerant gas into the suction chamber 3a to the outlet port 1b for discharging the refrigerant gas from the discharge chamber 3b. Included in the external refrigeration circuit 35 are a condenser 36, an expansion valve 37 and an evaporator 38. The expansion valve 37 controls the flow rate of the refrigerant in accordance with a change in gas pressure on the outlet side of the evaporator 38.

A temperature sensor 39 is located near the evaporator 38. The temperature sensor 39 detects the temperature in the evaporator 38, and outputs a signal based on the detected temperature to a computer C. An engine speed sensor 41 detects the rotational speed of the engine and outputs a signal based on the detected engine speed to the computer C.

The computer C controls the solenoid 33 of the electromagnetic valve 32. More specifically, the computer C energizes or de-energizes the solenoid 33 based on the ON action or OFF action of an activation switch 40 for activating the air conditioning system. When the temperature detected by the temperature sensor 39 becomes equal to or below a set value with the activation switch 40 set on, the computer C de-energizes the solenoid 33. At the temperature equal to or below this set value, frosting may occur in the evaporator 38. Further, when the engine speed detected by the engine speed sensor 41 changes abruptly with the activation switch 40 set on, the computer C de-energizes the solenoid 33.

The engine speed sensor 41 outputs a signal based on the detected engine speed to an idle speed controller (ISC) 42. Based on the input signal, the ISC 42 outputs a duty signal to an actuator (not shown) for regulating the amount of air supplied to the engine to execute the feedback control so that the idling engine speed coincides with the target value.

The operation of the compressor will now be described.

Referring to FIGS. 1 and 5, the solenoid 33 is energized and the supply passage 31 is closed. Therefore, the refrigerant gas under high pressure in the discharge chamber 3b is not supplied inside the crank chamber 2a. In this situation, the refrigerant gas in the crank chamber 2a simply flows out to the suction chamber 3a via the passage 30 and the pressure in the crank chamber 2a approaches the low pressure in the suction chamber 3a, i.e., the suction pressure. As a result, the difference between the pressure in the crank chamber 2a and the pressure in the cylinder bores 1a becomes smaller and the inclined angle of the swash plate 15 becomes maximum. The discharge displacement of the compressor thus becomes maximum. The refrigerant gas in the crank chamber 2a passes through the inlet 30a provided near the lip seal 12. Accordingly, the lubricating oil suspended in the refrigerant gas lubricates and seals the area between the lip seal 12 and the drive shaft 9.

When the gas is discharged with the swash plate 15 kept at the maximum inclined angle while the cooling load of the compressor becomes lower, the temperature in the evaporator 38 falls to approach the value that may cause frosting. When the temperature detected by the temperature sensor 39 becomes equal to or lower than the set value, the computer C de-energizes the solenoid 33. When the solenoid 33 is de-energized, the supply passage 31 is opened to connect the discharge chamber 3b to the crank chamber 2a. Consequently, the refrigerant gas under high pressure in the discharge chamber 3b rapidly flows into the crank chamber 2a via the supply passage 31, rapidly raising the pressure in the crank chamber 2a. The difference between the pressure in the crank chamber 2a and the pressure in the cylinder bores 1a therefore increases and the inclined angle of the swash plate 15 becomes smaller rapidly.

As the inclined angle of the swash plate 15 becomes smaller, the spool 21 is pushed backward via the pipe 28 and the ball bearing 25. Consequently, the distal end of the spool 21 approaches the positioning surface 27. This movement gradually restricts the cross-sectional area of the passage extending from the suction passage 26 to the suction chamber 3*a*. The amount of the refrigerant gas flowing into the suction chamber 3*a* from the suction passage 26 therefore decreases gradually. As a result, the amount of the refrigerant gas sucked into the cylinder bores 1*a* from the suction chamber 3*a* also decreases gradually, and the discharge displacement decreases gradually. While the inclined angle of the swash plate 15 becomes smaller quickly, the discharge pressure falls gradually and the torque needed to drive the compressor becomes smaller gradually. Therefore, the torque does not vary significantly in a short period of time.

When the distal end of the spool 21 abuts on the positioning surface 27, the spool 21 blocks the suction passage 26 from the suction chamber 3*a* as shown in FIGS. 4 and 6.

Consequently, the refrigerant gas stops flowing into the suction chamber 3*a* from the external refrigeration circuit 35. When the distal end of the spool 21 abuts on the positioning surface 27, the inclined angle of the swash plate 15 becomes the minimum. Since the minimum inclined angle of the swash plate 15 is not zero degrees, the refrigerant gas is discharged into the discharge chamber 3*b* from the cylinder bores 1*a* even when the inclined angle of the swash plate 15 is minimized. Even when the inclined angle of the swash plate 15 is minimized, therefore, there are pressure differences between the discharge chamber 3*b*, the crank chamber 2*a* and the suction chamber 3*a*.

The refrigerant gas discharged to the discharge chamber 3*b* from the cylinder bores 1*a* flows into the crank chamber 2*a* via the supply passage 31. The refrigerant gas in the crank chamber 2*a* flows into the suction chamber 3*a* axial passage 30 and the through hole 21*c*, and the refrigerant gas in the suction chamber 3*a* is drawn into the cylinder bores 1*a* to be discharged to the discharge chamber 3*b*. With the inclined angle of the swash plate 15 at the minimum angle, therefore, a circulating passage means including the discharge chamber 3*b*, the supply axial passage 31, the crank chamber 2*a*, the passage 30, the through hole 21*c*, the suction chamber 3*a* and the cylinder bores 1*a* is formed in the compressor. The refrigerant gas discharged to the discharge chamber 3*b* circulates along this circulating passage means and will not flow out to the external refrigeration circuit 35. Therefore, no frosting will occur in the evaporator 38. At this time, the cross-sectional area of the pressure decreasing passage means running from the crank chamber 2*a* to the suction chamber 3*a* is defined by the cross-sectional area $S_1$ of the through hole 21*c*. Further, the individual portions in the compressor are lubricated by the lubricating oil suspended in the refrigerant gas.

When the cooling load of the compressor increases from the state shown in FIGS. 4 and 6, this increase in cooling load appears as a rise in the temperature in the evaporator 38. When the temperature detected by the temperature sensor 39 exceeds the set value, the computer C energizes the solenoid 33. When this energization happens, the supply passage 31 is closed to disconnect the discharge chamber 3*b* from the crank chamber 2*a*. Under this situation, the refrigerant gas in the crank chamber 2*a* flows out to the suction chamber 3*a* via the passage 30 and the through hole 21*c*, and the pressure in the crank chamber 2*a* approaches the suction pressure. As a result, the inclined angle of the swash plate 15 shifts toward the maximum inclined angle from the minimum inclined angle.

As the inclined angle of the swash plate 15 increases, the spool 21 gradually moves away from the positioning surface 27 due to the urging force of the spring 24. This movement gradually increases the cross-sectional area of the passage extending from the suction passage 26 to the suction chamber 3*a*. The amount of the refrigerant gas flowing into the suction chamber 3*a* from the suction passage 26 therefore increases gradually. As a result, the amount of the refrigerant gas drawn into the cylinder bores 1*a* from the suction chamber 3*a* also increases gradually, and the discharge displacement increases gradually. Consequently, the discharge pressure rises gradually and the torque needed to drive the compressor becomes larger gradually. Therefore, the torque does not vary significantly in a short period of time.

Even when the solenoid 33 is de-energized in the state in FIG. 5 due to the OFF action of the activation switch 40 or a drastic change in the engine speed, the inclined angle of the swash plate 15 shifts toward the minimum inclined angle from the maximum inclined angle. When the activation switch 40 is switched on or the drastic change in the engine speed occurs in the state in FIG. 6, the solenoid 33 is energized. When the cooling load of the compressor is large then, the inclined angle of the swash plate 15 shifts toward the maximum inclined angle from the minimum inclined angle.

When the engine stops, the compressor stops running and the solenoid 33 is de-energized, causing the inclined angle of the swash plate 15 to shift toward the minimum inclined angle. With the operation of the compressor stopped, therefore, the swash plate 15 is held at the minimum inclined angle.

While the swash plate 15 moves to the intermediate inclined angle indicated by the chain line in FIG. 6 from the minimum inclined angle, the connection passage 21*d* on the spool 21 is blocked from the inlet 14*a* of the passage 14. In this situation, the amount of the refrigerant gas through the pressure decreasing passage means running from the crank chamber 2*a* to the suction chamber 3*a* accords to the cross-sectional area $S_1$ of the through hole 21*c*. Thus, the pressure in the crank chamber 2*a* is gently decreased in a certain period of time. The time for the inclined angle of the swash plate 15 to shift to the maximum inclined angle from the minimum inclined angle is determined by the size of the cross-sectional area $S_1$.

When the swash plate 15 rapidly moves to the maximum inclined angle from the minimum inclined angle, the discharge pressure increases drastically and so does the torque needed to drive the compressor. As a result, the load torque to the engine radically increases and the idling engine speed drastically decreases. When the feedback control of the ISC 42 cannot follow this drastic change, the engine may stall or the control of the energization and de-energization of the electromagnetic valve 32, which is executed by the computer C, may be repeated excessively.

Figures 8A, 8B, 8C:
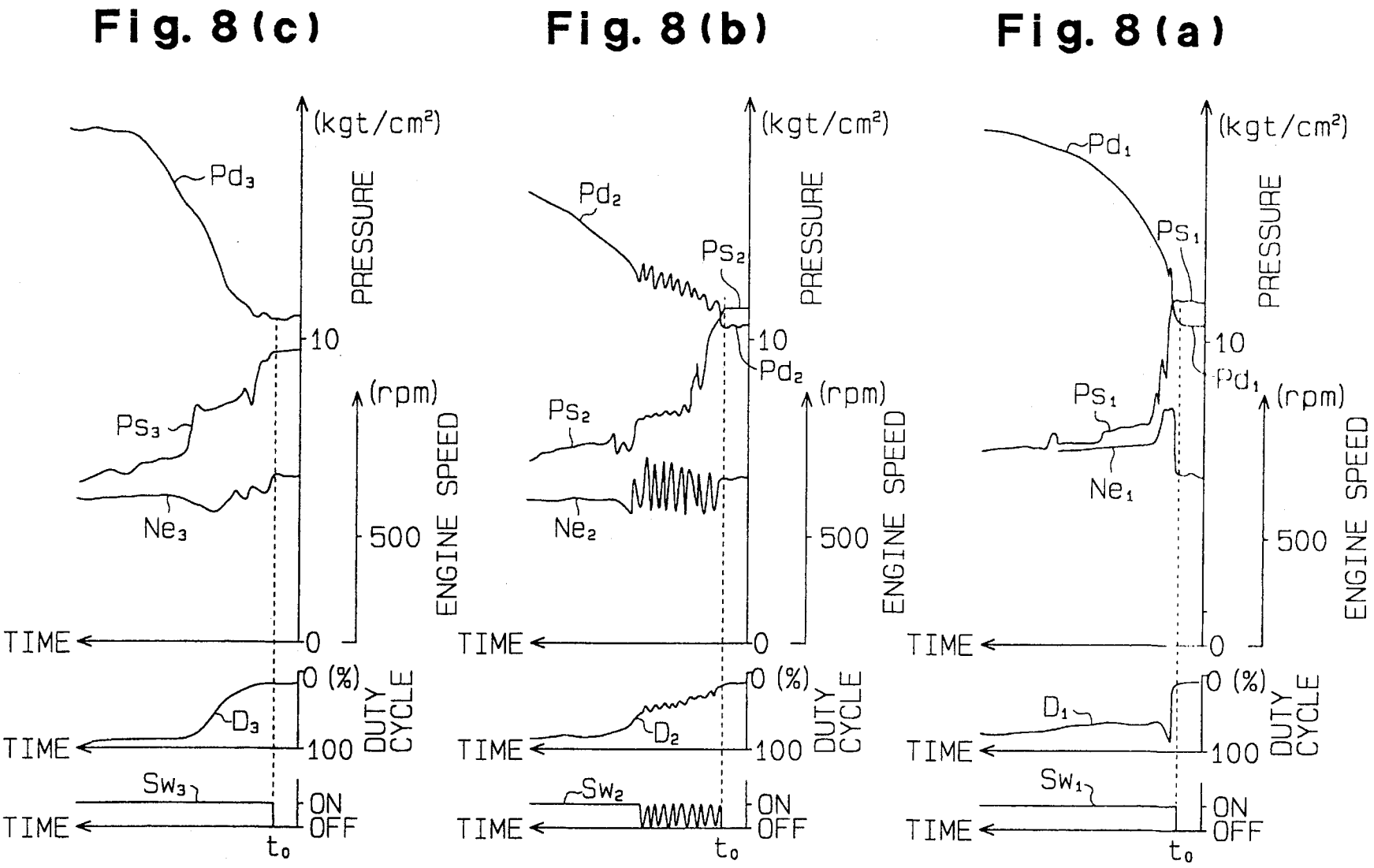
FIGS. 8(*a*) and 8(*b*) are graphs showing variations in the suction pressure, the discharge pressure, the engine speed, the excitation/de-excitation of the electromagnetic valve and the cycle of the duty signal in the ISC when the cross-sectional area of the passage is constant.

Each of the graphs in FIGS. 8(*a*), 8(*b*) and 8(*c*) shows variations in the suction pressure, the discharge pressure, the engine speed, the excitation/de-excitation of the electromagnetic valve 32 and the cycle of the duty signal in the ISC 42. Curves $Ps_1$, $Ps_2$ and $Ps_3$ indicate the suction pressure; curves $Pd_1$, $Pd_2$ and $Pd_3$ indicate the discharge pressure; curves $Ne_1$, $Ne_2$ and $Ne_3$ indicate the engine speed; curves $Sw_1$, $Sw_2$ and $Sw_3$ indicate the excitation and de-excitation of the electromagnetic valve 32; and curves $D_1$, $D_2$ and $D_3$ indicate the cycle. The horizontal scale represents time, and the de-energized electromagnetic valve 32 is excited at time $t_0$ in those graphs.

The graphs in FIGS. 8(*a*) and 8(*b*) show experimental data when the cross-sectional area of the pressure decreasing passage means extending from the crank chamber to the suction chamber is always set to a constant regardless of the inclined angle of the swash plate; the cross-sectional area in this case is set to $S_1+S_2$. Here, the target engine speed in the feedback control of the ISC 42 when the electromagnetic valve 32 is excited is $N_1$. The target engine speed in the feedback control of the ISC 42 when the electromagnetic valve 32 is de-energized is $N_2$. In this case, the experimental data in FIG. 8(*a*) is obtained by setting the target engine speed $N_1$ with the energized electromagnetic valve 32 higher than the target engine speed $N_2$ with the de-energized electromagnetic valve 32, i.e., $N_1>N_2$. The experimental data in FIG. 8(*b*) is obtained by setting the target engine speed always to $N_2$ regardless of whether or not the electromagnetic valve 32 is energized. The target speed $N_1$ is set in consideration of the torque needed to drive the compressor when the inclined angle of the swash plate is at the maximum.

In the experiments in FIGS. 8(*a*) and 8(*b*), the cross-sectional area of the pressure decreasing passage means $S_1+S_2$, one experimental condition, is needed to stably hold the swash plate at the maximum inclined angle. In the experiments in FIGS. 8(*a*) and 8(*b*) where the cross-sectional area of the pressure decreasing means extending from the crank chamber to the suction chamber is set to $S_1+S_2$, the swash plate promptly shifts to the maximum inclined angle from the minimum inclined angle. In the experiments in FIGS. 8(*a*) and 8(*b*), therefore, the torque needed to drive the compressor drastically varies during the shifting of the swash plate to the maximum inclined angle from the minimum inclined angle.

In the experiment illustrated in FIG. 8(*a*), when the electromagnetic valve 32 is energized or when the swash plate is ready to shift to the maximum inclined angle, the target engine speed for the idling engine is set higher than the target engine speed with the de-energized electromagnetic valve 32. Even when the torque needed to drive the compressor increases drastically, therefore, engine stall and excessive actuation of the electromagnetic valve 32 are avoided. However, the increase in the target engine idle speed increases the fuel consumption of the vehicle.

In the experiment in FIG. 8(*b*), since the target engine idle speed is always constant, the engine speed varies significantly immediately after time $t_0$ at which the electromagnetic valve 32 has been excited, so that the energization and de-energization of the electromagnetic valve 32 are excessively repeated. In other words, the feedback control of the ISC 42 may not follow the rapid decrease in the engine speed caused by the drastic increase in torque. As a result, the engine may stall.

The graph in FIG. 8(*c*) shows experimental data with the compressor of this embodiment in use. When the swash plate 15 is positioned in the range of the intermediate inclined angle (excluding around the maximum inclined angle and in the vicinity of the minimum inclined angle continuous to this range), the cross-sectional area of the pressure decreasing passage means extending from the crank chamber 2*a* to the suction chamber 3*a* becomes equal to the cross-sectional area $S_1$ of the through hole 21*c*. This cross-sectional area $S_1$ is smaller than $S_1+S_2$, which is the cross-sectional area in the experiments in FIGS. 8(*a*) and 8(*b*). Therefore, the time for the swash plate 15 to reach the maximum inclined angle from the minimum inclined angle is longer than that in the experiments in FIGS. 8(*a*) and 8(*b*) and the increase in torque during this angle transition of the swash plate 15 to the maximum inclined angle from the minimum inclined angle becomes gentler. The ISC 42 can therefore perform the feedback control in response to a change in engine speed caused by the increased torque. This can suppress the sudden fall of the engine speed immediately after the time $t_0$ at which the electromagnetic valve 32 has been energized. According to this embodiment, therefore, engine stall is avoided.

In this embodiment, the supply of the refrigerant gas to the suction chamber 3*a* from the external refrigeration circuit 35 is allowed or inhibited by moving the spool 21 in response to the inclination of the swash plate 15. The use of this spool 21 prevents frosting from occurring in the evaporator 38 when there is no cooling load on the compressor and effectively suppresses the torque change when the swash plate 15 is shifted between the maximum inclined angle and the minimum inclined angle. Although the opening and closing of the supply passage 31 are frequently repeated in accordance with a change in the cooling load of the compressor, the change-oriented shock can be absorbed because the drastic change in torque is suppressed by the action of the spool 21.

A second embodiment of the present invention will now be described with reference to FIGS. 9 through 12. In this embodiment, the members identical to those in the first embodiment are indicated by the same numerals and not explained.

Figure 9:
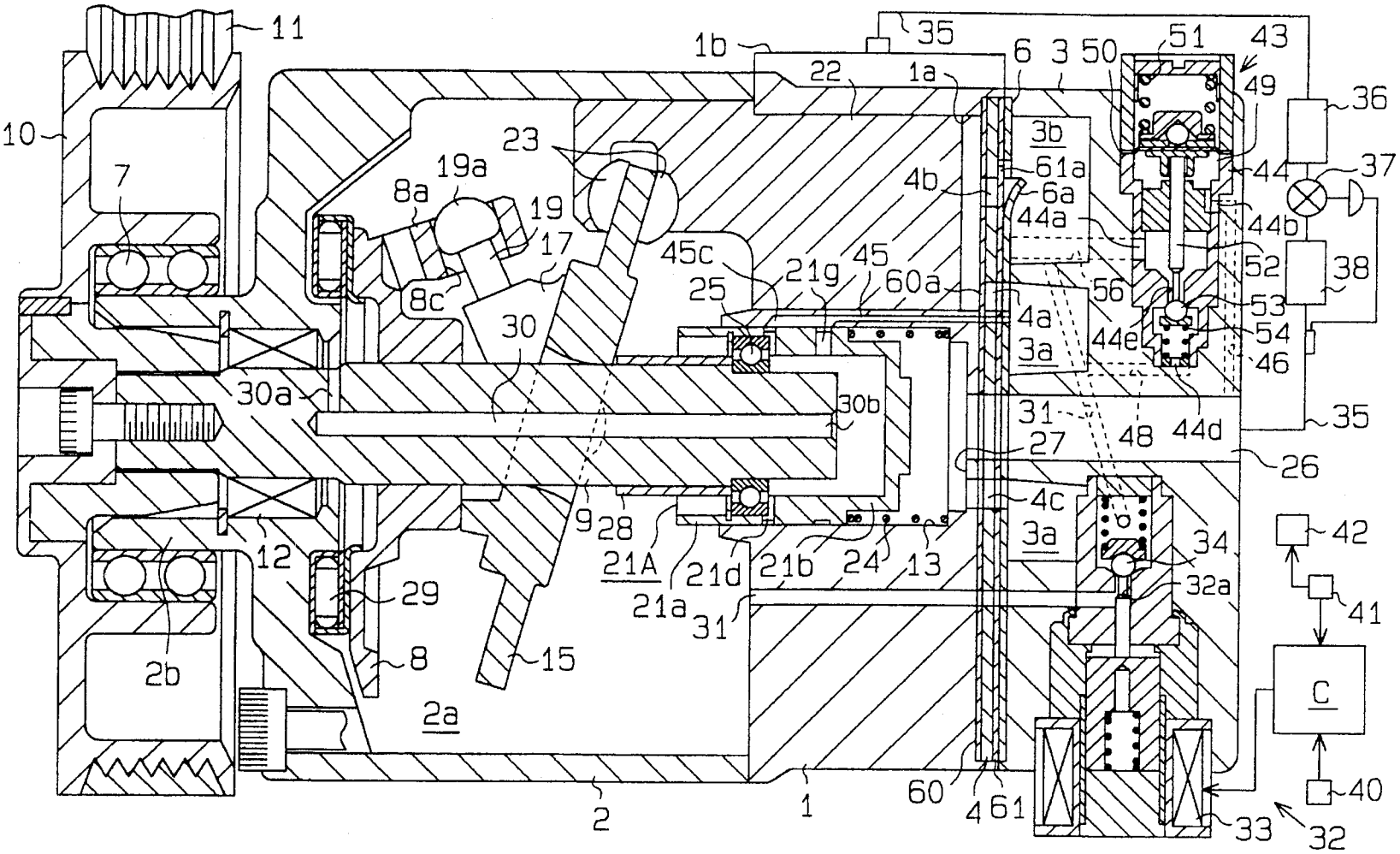
FIG. 9 is a side cross-sectional view of an overall compressor according to the second of the present invention.

In the second embodiment, a displacement control valve 43 is attached to the rear housing 3 as shown in FIG. 9. The pressure in the crank chamber 2*a* is controlled by this control valve 43. A valve housing 44 of the control valve 43 is provided with a first port 44*a*, a second port 44*b* and a third port 44*d*. The first port 44*a* communicates with the crank chamber 2*a* via a passage 56. Available flow controlling passage 45 communicates with the suction chamber 3*a* and its inlet 45*c* is open to the inner wall of the shutter chamber 13. A pair of connection passages 21*d* and 21*g* are formed in a spool 21A. The connection passages 21*d* and 21*g* are connectable to the inlet 45*c*. The second port 44*b* communicates with the suction passage 26 via an inlet passage 46. The third port 44*d* communicates with the discharge chamber 3*b* via an inlet passage 48.

A suction pressure detection chamber 49 communicates with the second port 44*b*. The pressure in this detection chamber 49 acts against an adjust spring 51 via a diaphragm 50. The urging force of the adjust spring 51 is transmitted to a valve body 53 via the diaphragm 50 and a rod 52. The urging force of a spring 54 acts on the valve body 53 in the direction to close a valve hole 44*e*. In accordance with a change in suction pressure in the detection chamber 49, the valve body 53 opens or closes the valve hole 44*e*. When the valve hole 44*e* is closed, the first port 44*a* is disconnected from the third port 44*d*, causing the discharge chamber 3*b* to be disconnected from the crank chamber 2*a*.

The connection passage 21*d* has the same cross-sectional area $S_1$ as hole 21*c* of the first embodiment. The connection passage 21*g* has the same cross-sectional area $S_2$ as inlet 14*a* of the first embodiment. When the inclined angle of the swash plate 15 is the maximum, both connection passages 21*d* and 21*g* are connected to the inlet 45*c*. In this situation, the cross-sectional area of the pressure decreasing passage means running from the crank chamber 2*a* to the suction chamber 3*a* becomes $S_1+S_2$ and the swash plate 15 is stably held at the maximum inclined angle. When the swash plate 15 is positioned in the range from the intermediate inclined angle indicated by the broken line in FIG. 10 to the minimum inclined angle shown in FIG. 11, only the connection passage 21*d* is connected to the inlet 45*c*.

Figure 10:
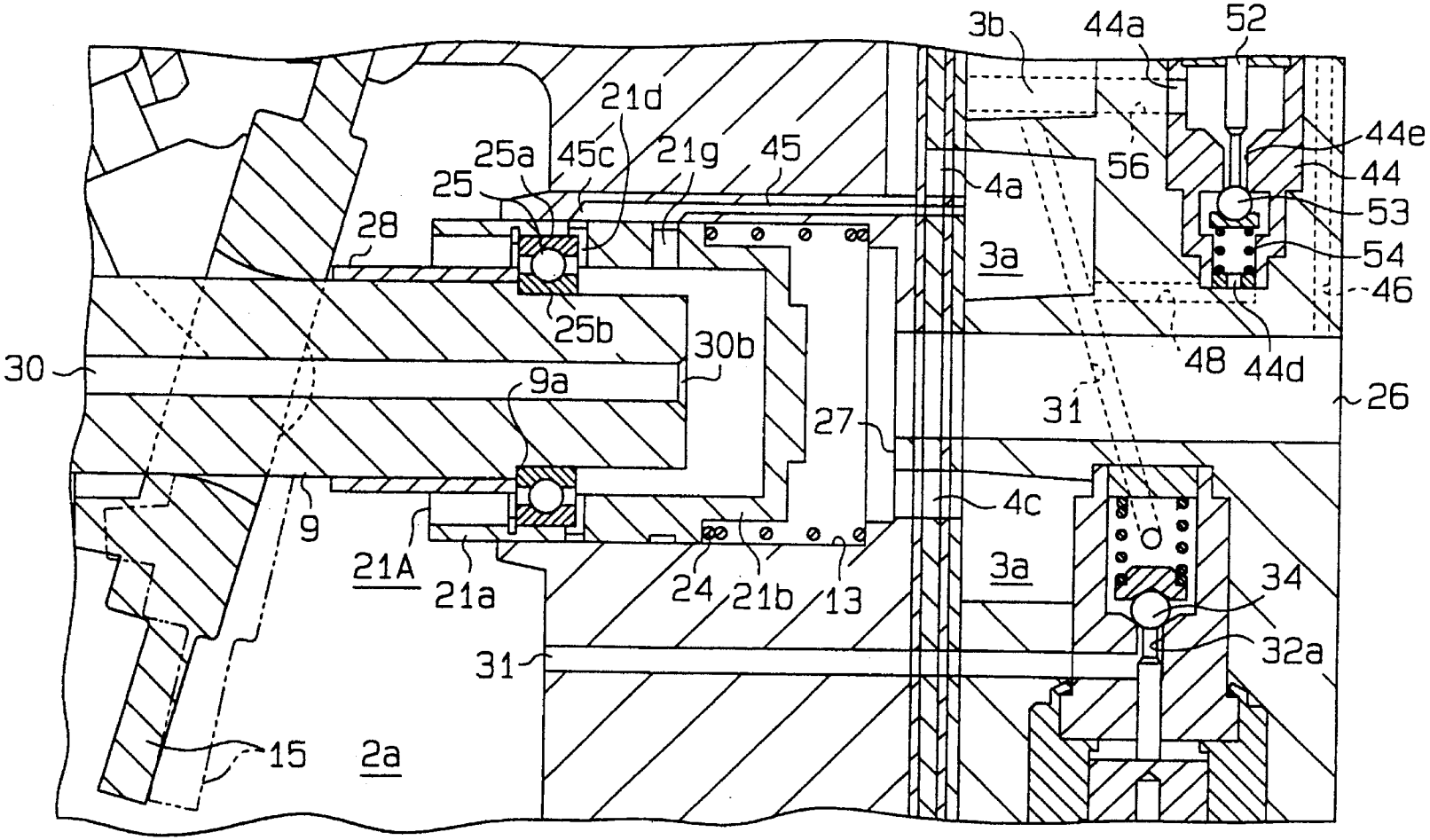
FIG. 10 is an enlarged cross-sectional view of a portion of the compressor of FIG. 9 with its swash plate at the maximum inclined angle.

When the cooling load of the compressor is large and the suction pressure is high with the solenoid 33 being energized to close the supply passage 31, the pressure in the detection chamber 49 increases and the size of the opening of the valve hole 44*e* by the valve body 53 becomes smaller. As the size of the opening of the valve hole 44*e* becomes smaller, the amount of the refrigerant gas flowing into the crank chamber 2*a* from the discharge chamber 3*b* decreases. As a result, the pressure in the crank chamber 2*a* falls. Since the suction pressure in the cylinder bores 1*a* is high, the difference between the pressure in the crank chamber 2*a* and the pressure in the cylinder bores 1*a* decreases. Accordingly, the inclined angle of the swash plate 15 becomes larger as shown in FIG. 10.

When the cooling load of the compressor is small and the suction pressure is low, the size of the opening of the valve hole 44*e* by the valve body 53 increases and the amount of the refrigerant gas flowing into the crank chamber 2*a* from the discharge chamber 3*b* increases. Consequently, the pressure in the crank chamber 2*a* rises. As the suction pressure in the cylinder bores 1*a* is low, the difference between the pressure in the crank chamber 2*a* and the pressure in the cylinder bores 1*a* increases. Therefore, the inclined angle of the swash plate 15 becomes smaller.

Figure 11:
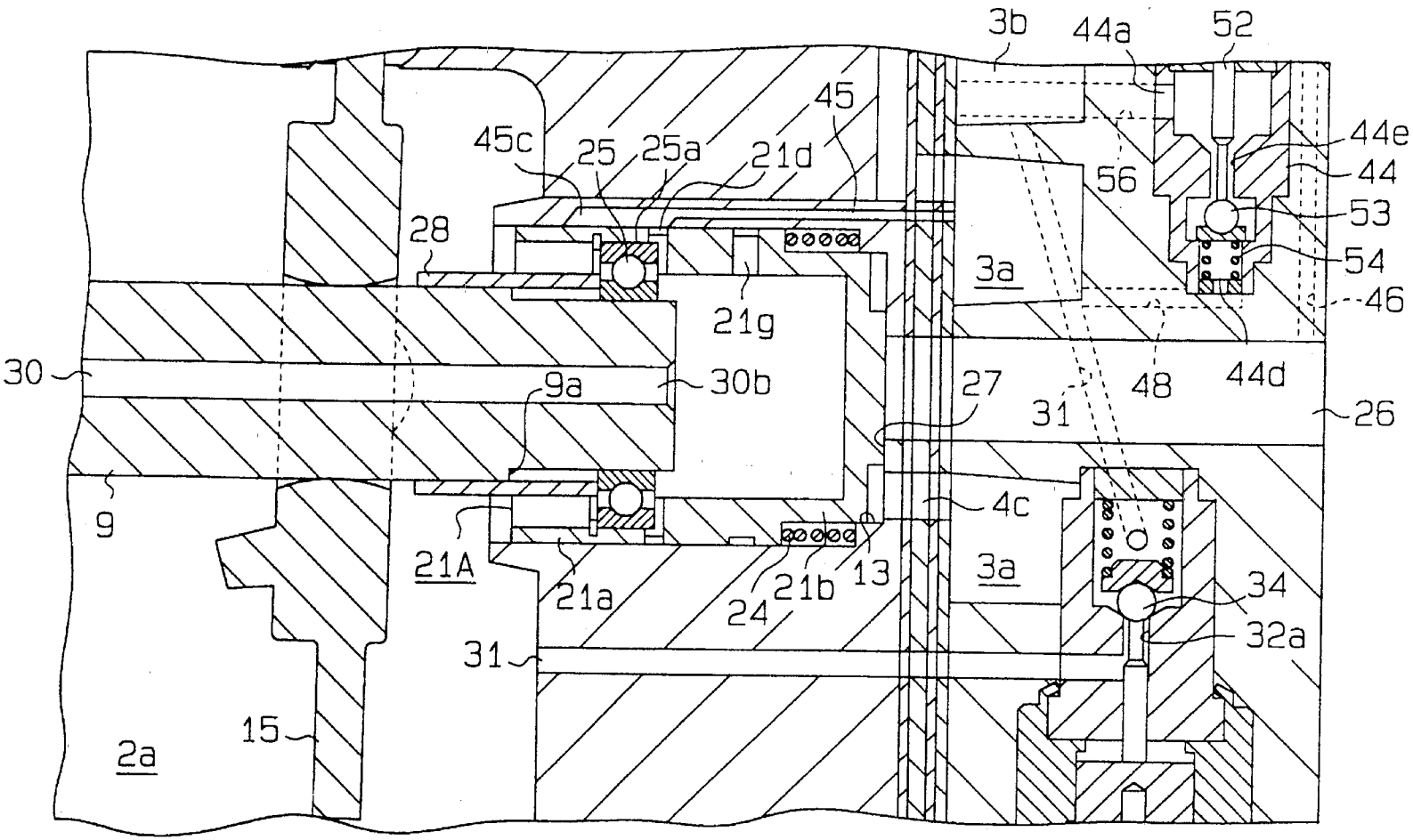
FIG. 11 is an enlarged cross-sectional view of a portion of the compressor of FIG. 9 with its swash plate at the minimum inclined angle.
Figure 12:
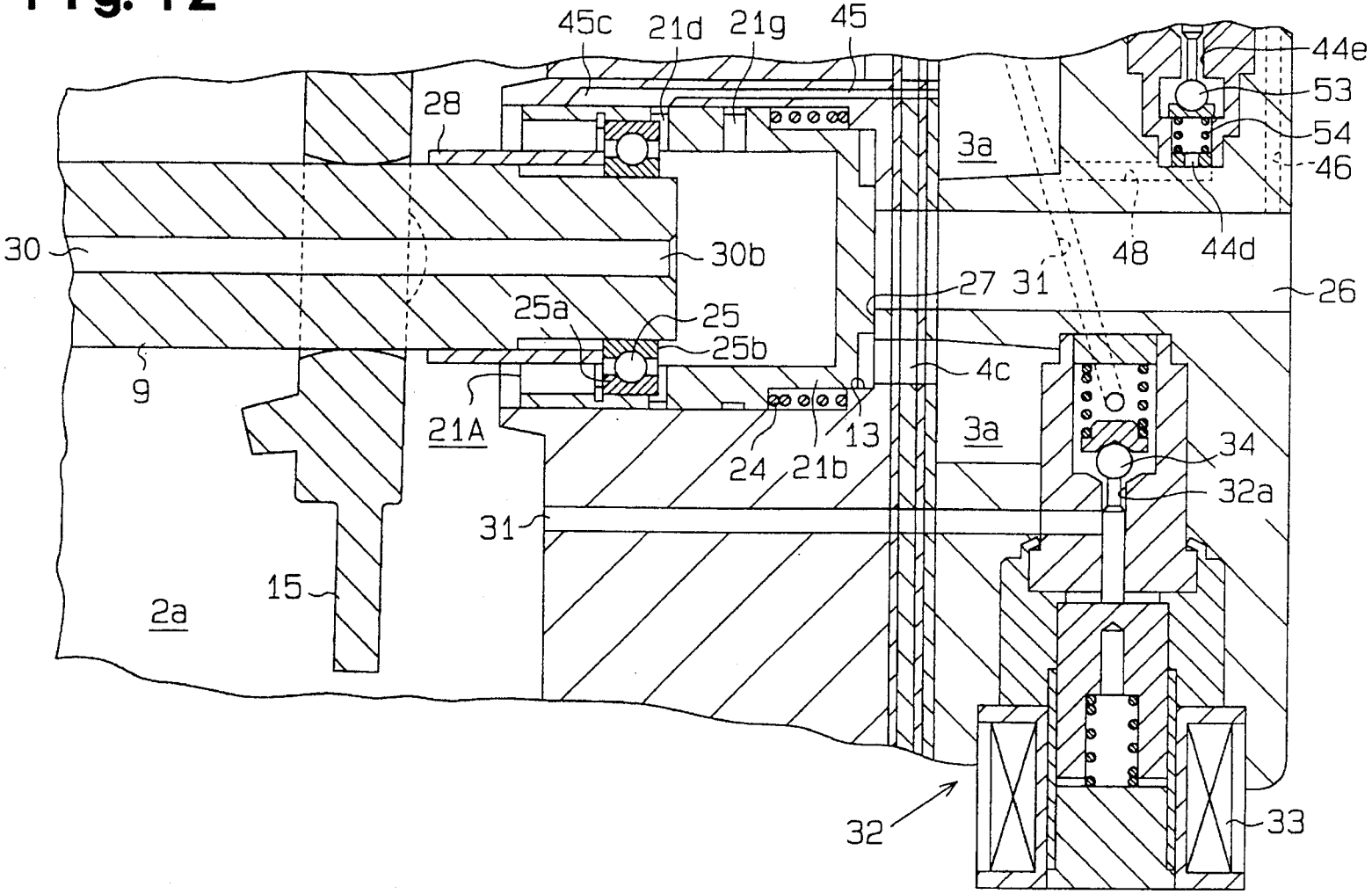
FIG. 12 is an enlarged cross-sectional view of a portion of the compressor of FIG. 9 with its swash plate at the minimum inclined angle.

When the cooling load of the compressor is very small and the suction pressure is very low, the angle of the opening of the valve hole 44*e* by the valve body 53 becomes maximum as shown in FIG. 11. When the solenoid 33 is de-energized, the valve body 34 opens the valve hole 32*a*, opening the supply passage 31 as shown in FIG. 12. Consequently, the pressure in the crank chamber 2*a* rises quickly and the swash plate 15 moves rapidly toward the minimum angle.

When the solenoid 33 is energized from the state shown in FIG. 12, the supply passage 31 is blocked and the swash plate 15 moves toward the maximum inclined angle from the minimum inclined angle. While the swash plate 15 moves to the intermediate inclined angle indicated by the broken line in FIG. 10 from the minimum inclined angle, the cross-sectional area of the pressure decreasing passage means from the crank chamber 2*a* to the suction chamber 3*a* is also defined by the cross-sectional area $S_1$ of the connection passage 21*d* in the second embodiment. Therefore, the inclined angle of the swash plate 15 gradually increases, so that engine stall is avoided.

A third embodiment of this invention will be described below with reference to FIG. 13. In this embodiment, the members identical to those in the first embodiment are indicated by the same numerals and not explained.

Figure 13:
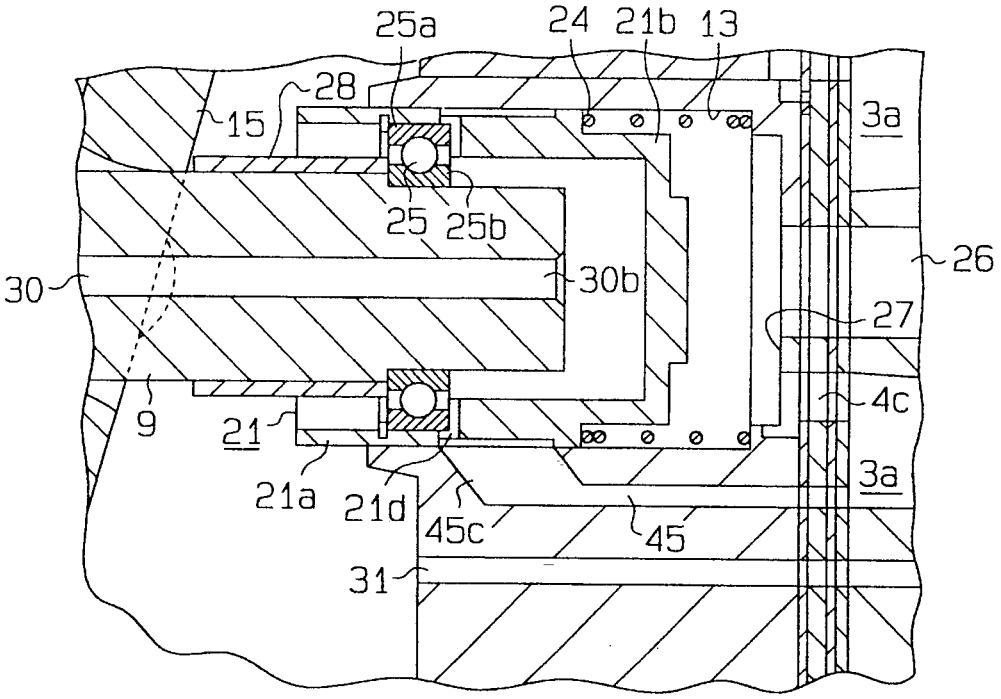
FIG. 13(*a*) is an enlarged cross-sectional view of a portion of the compressor with its swash plate at the maximum inclined angle according to the third embodiment of the present invention.
Figure 13:
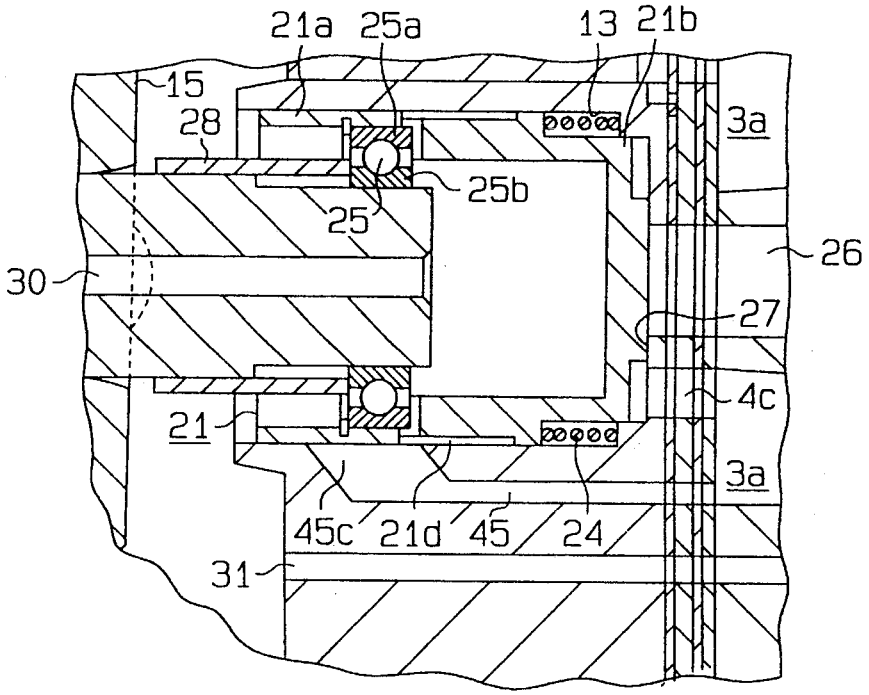

In this third embodiment, the inlet 45*c* of the passage 45 is permanently connected to the connection passage 21*d* as shown in FIGS. 13(*a*) and 13(*b*), and the cross-sectional area of this connected portion continuously changes in accordance with a change in the inclined angle of the swash plate 15. The cross-sectional area of the connected portion becomes $S_1+S_2$ when the inclined angle of the swash plate 15 is at the maximum and becomes $S_1$ when the inclined angle of the swash plate 15 is at the minimum. The inclined angle of the swash plate 15 can be increased gradually as in the previous embodiment by continuously changing the cross-sectional area of the pressure decreasing passage means from the crank chamber 2*a* to the suction chamber 3*a*.

A fourth embodiment of this invention will be described below with reference to FIGS. 14 through 17. In this embodiment, the members identical to those in the first embodiment are indicated by the same numerals and not explained.

In this fourth embodiment, a connection pipe 57 is slidably supported on the drive shaft 9. A snap ring 58 is located between the distal end of the connection pipe 57 and the swash plate 15. A flange portion 57*a* at the proximal end of the connection pipe 57 is engaged with the inlet race 25*b* of the ball bearing 25. A pipe 28 or actuating member is supported on the pipe 57. The pipe 28 permanently abuts on both the swash plate 15 and the inner race 25*b*. The spool 21 is therefore coupled via the connection pipe 57 and the pipe 28 to the swash plate 15 in such a way as to be movable together. This eliminates the need for the spring 24 in the above-described embodiments.

Figure 14:
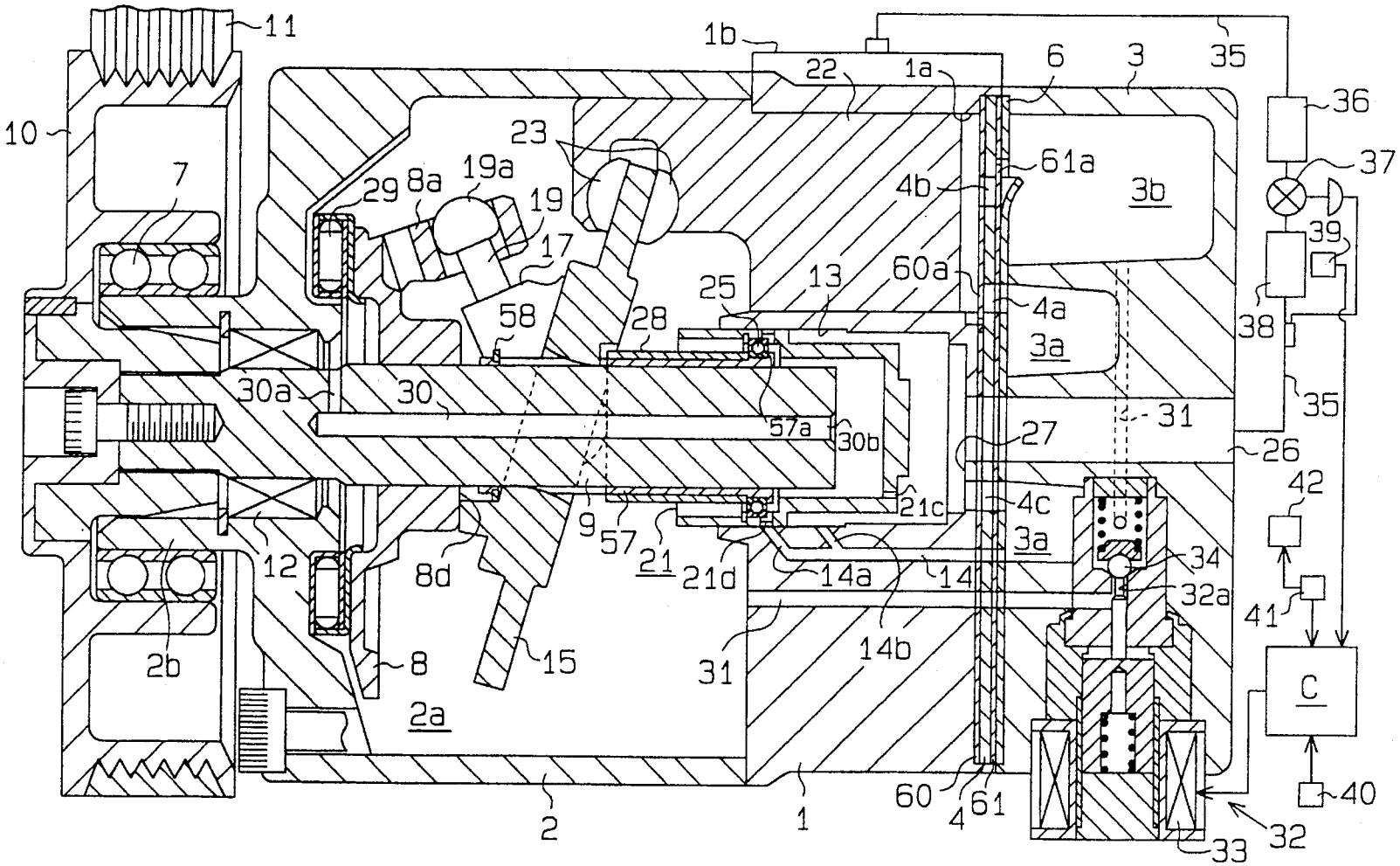
FIG. 14 is a side cross-sectional view of a compressor according to the fourth embodiment of the present invention.
Figure 15:
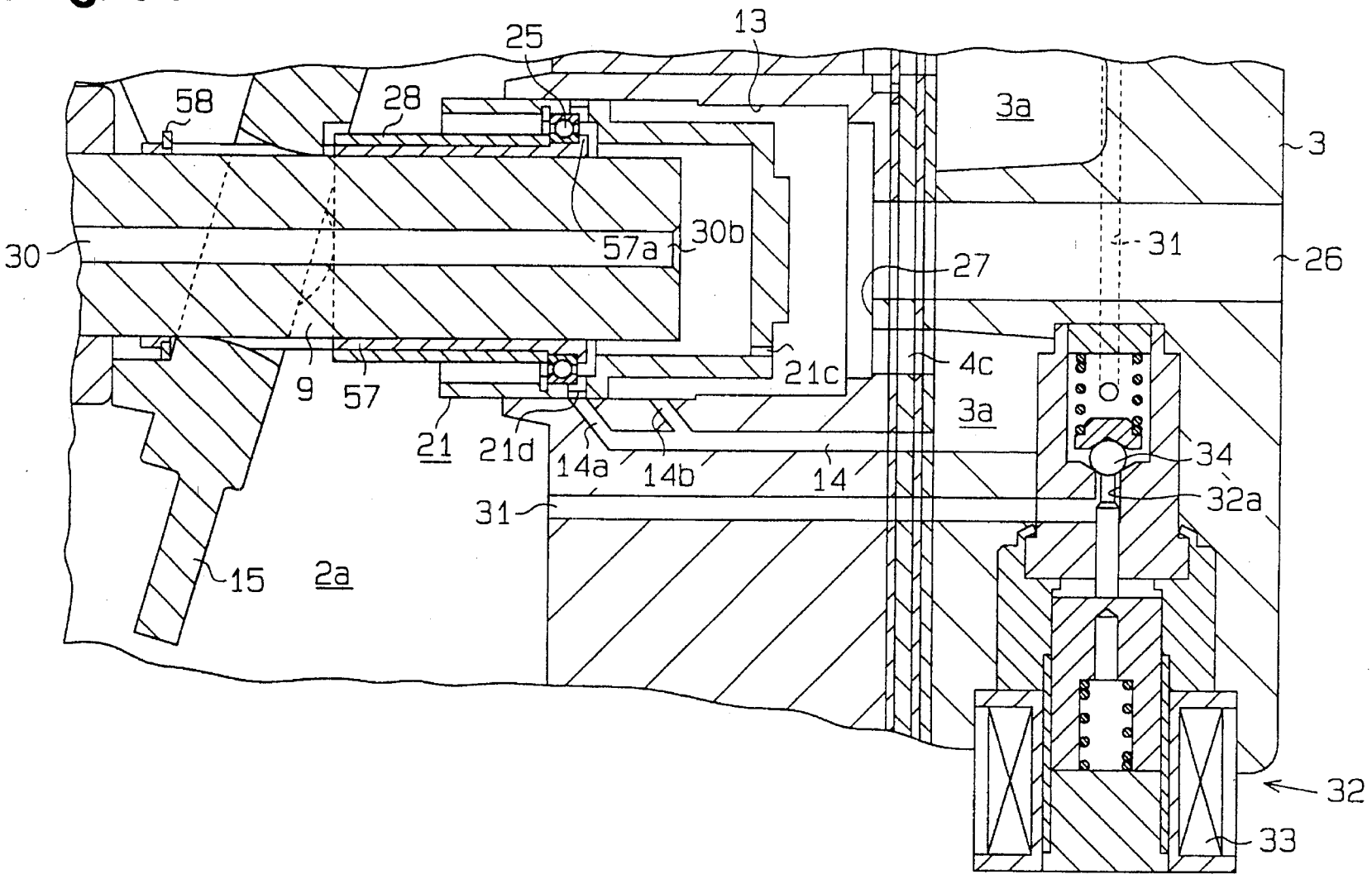
FIG. 15 is an enlarged cross-sectional view of a portion of the compressor of FIG. 14 with its swash plate at the maximum inclined angle.
Figure 16:
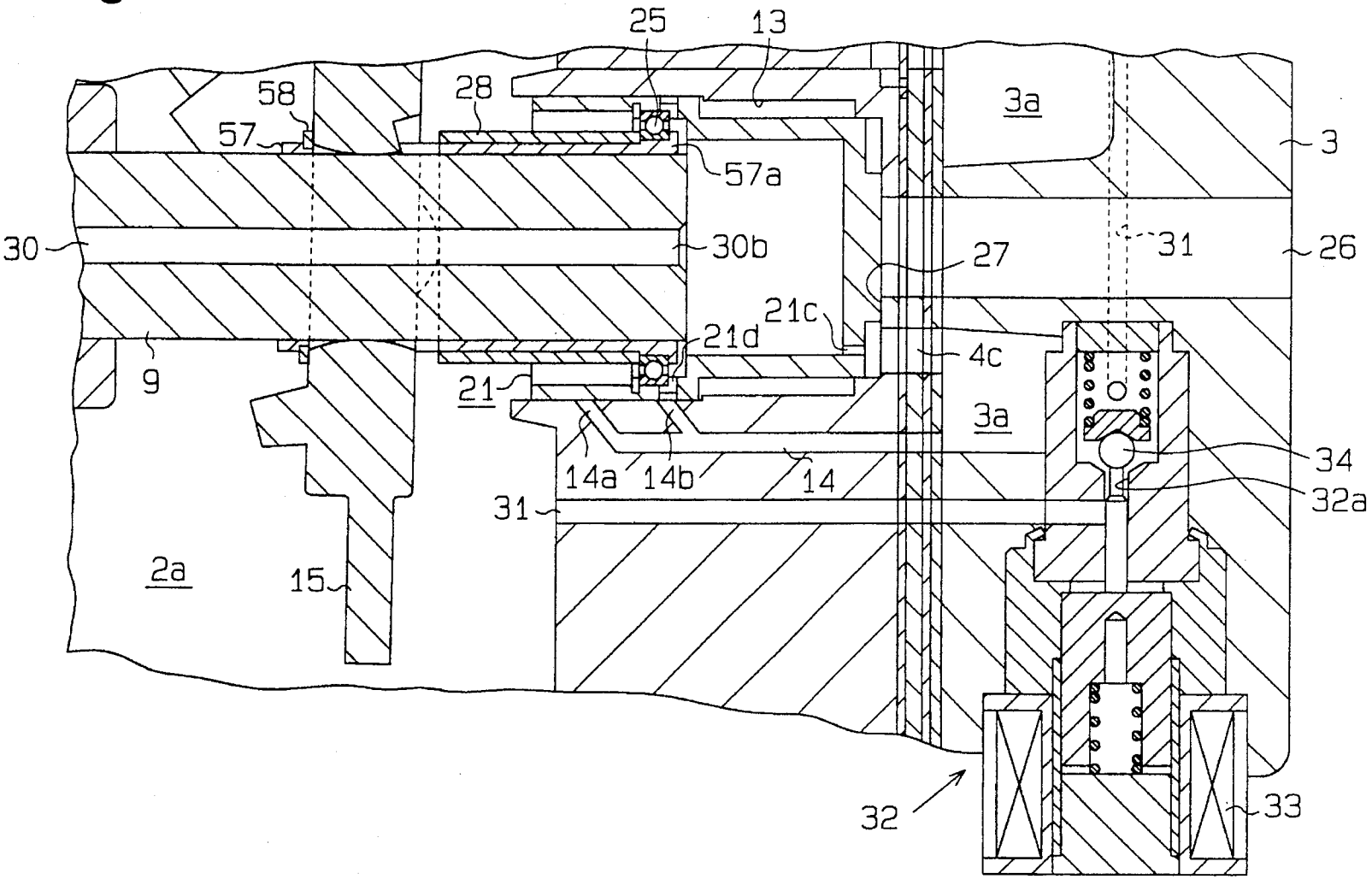
FIG. 16 is an enlarged cross-sectional view of a portion of the compressor of FIG. 14 with its swash plate at the minimum inclined angle.

In addition to the inlet 14*a*, another inlet 14*b* is formed in the passage 14 in the cylinder block 1. Each inlet 14*a* and 14*b* has a cross-sectional area $S_2$. As shown in FIGS. 14 and 15, when the swash plate 15 is in the vicinity of the position of the maximum inclined angle, the connection passage 21*d* on the spool 21 is connected to the inlet 14*a*. When the swash plate 15 is in the vicinity of the position of the minimum inclined angle, the connection passage 21*d* is connected to the inlet 14*b*, as shown in FIG. 16. When the swash plate 15 is near the position of the intermediate inclined angle, the connection passage 21*d* is connected to neither the inlet 14*a* nor the inlet 14*b*.

Figure 17:
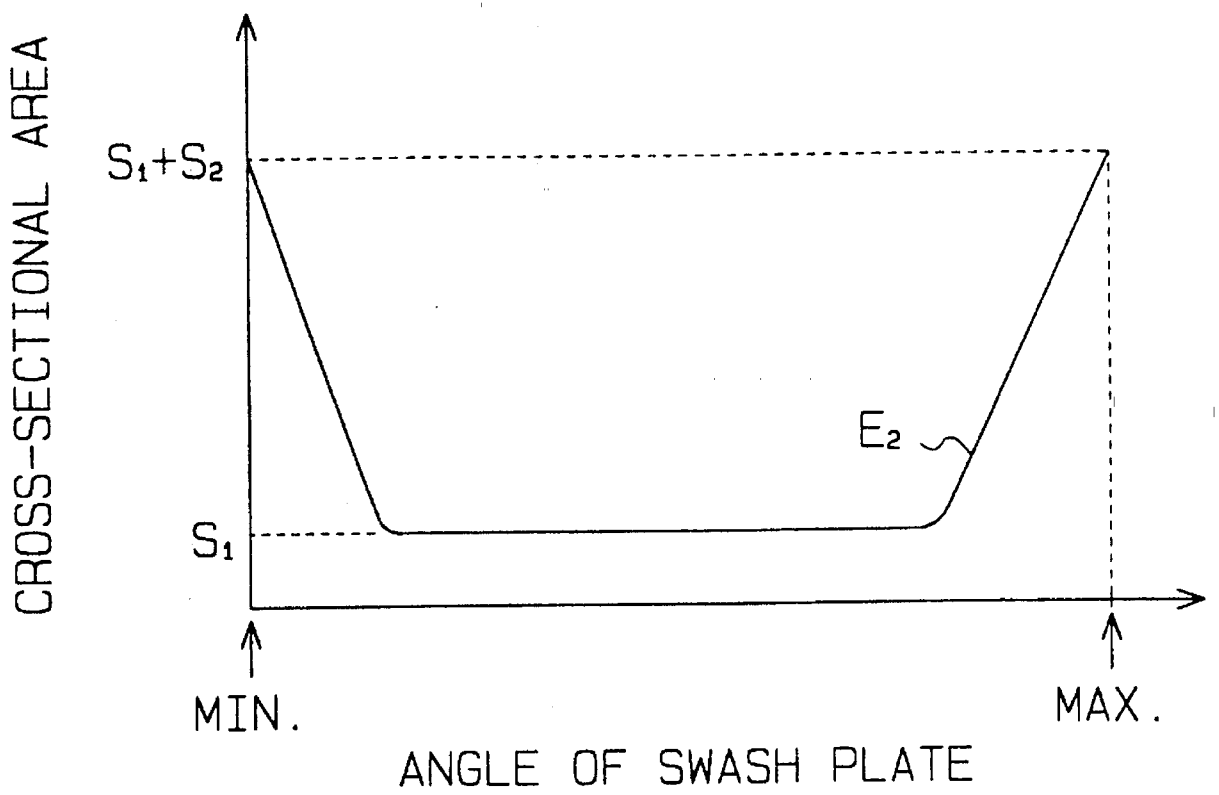
FIG. 17 is a graph indicating how the cross-sectional area of the passage running from the crank chamber to the suction chamber varies.

The cross-sectional area of the passage from the crank chamber 2*a* to the suction chamber 3*a* changes along the curve $E_2$ in the graph of FIG. 17 in accordance with the inclined angle of the swash plate 15. When the swash plate 15 is positioned near the intermediate angle, the cross-sectional area of the passage is defined by the cross-sectional area $S_1$ of the through hole 21*c*. Therefore, the increase in torque during the movement of the swash plate 15 to the maximum inclined angle from the minimum inclined angle becomes gentle, so that engine stall is avoided. When the swash plate 15 is at the minimum inclined angle, the cross-sectional area of the pressure decreasing passage means becomes $S_1+S_2$ as in the case where the swash plate 15 is at the maximum inclined angle. Therefore, with the swash plate 15 at the minimum inclined angle, the amount of lubricating oil circulating in the compressor is greater than that in each embodiment discussed above, thus ensuring better lubrication in the compressor when the swash plate 15 is at the minimum inclined angle.

A fifth embodiment of this invention will be described below with reference to FIGS. 18 and 19. In this embodiment, the members identical to those in the first embodiment are indicated by the same numerals and not explained.

Figure 18:
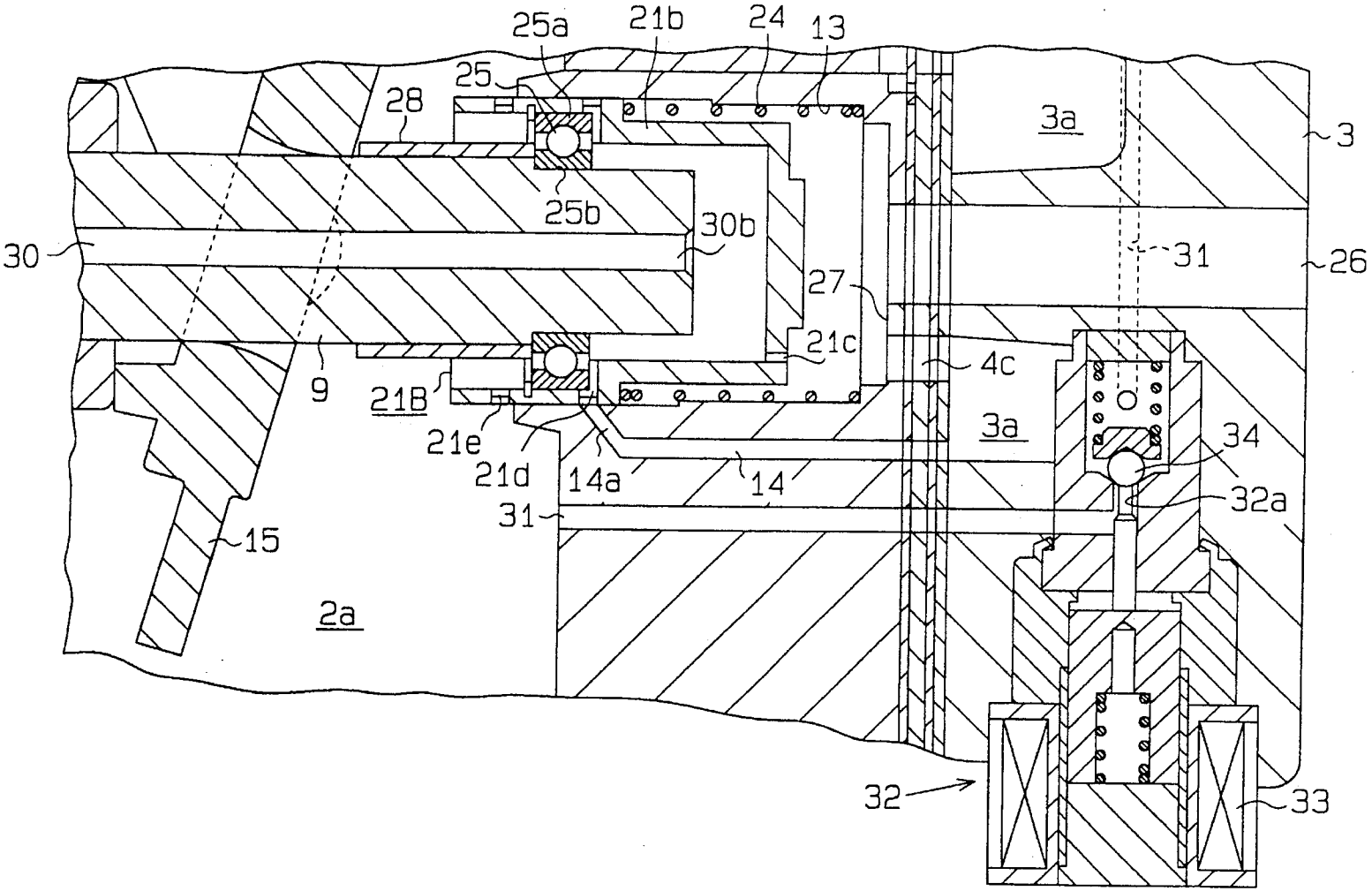
FIG. 18 is an enlarged cross-sectional view of essential parts showing the compressor whose swash plate is at the maximum inclined angle according to the fifth embodiment of the present invention.
Figure 19:
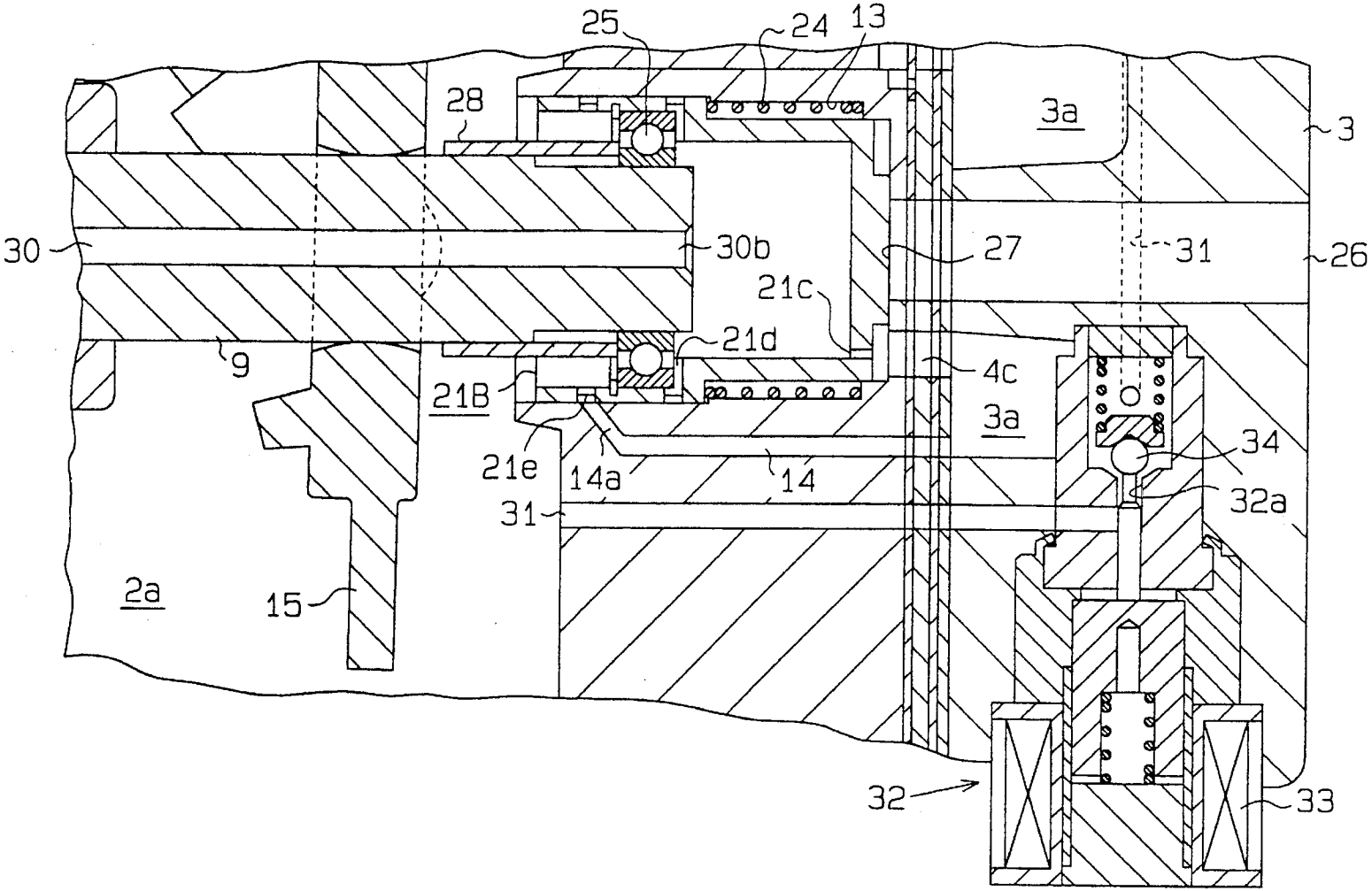
FIG. 19 is an enlarged cross-sectional view of a portion of the compressor of FIG. 18 with its swash plate at the minimum inclined angle.

In the fifth embodiment, the through hole 21*c*, the connection passage 21*d* and a connection passage 21*e* are formed in a spool 21B as shown in FIGS. 18 and 19. When the swash plate 15 is positioned near the maximum inclined angle, the connection passage 21*d* is connected to the inlet 14*a* of the passage 14*a*, as shown in FIG. 18. When the swash plate 15 is in the vicinity of the position of the minimum inclined angle, the connection passage 21*e* is connected to the inlet 14*a*, as shown in FIG. 19. When the swash plate 15 is positioned near the intermediate inclined angle, both connection passages 21*d* and 21*e* are disconnected from the inlet 14*a*.

The cross-sectional area of the pressure decreasing passage means from the crank chamber 2*a* to the suction chamber 3*a* therefore changes along the curve $E_2$ in the graph of FIG. 17 as discussed in the section of the fourth embodiment. Therefore, the increase in torque during the movement of the swash plate 15 to the maximum inclined angle from the minimum inclined angle becomes gentle, so that engine stall is avoided. With the swash plate 15 at the minimum inclined angle, the cross-sectional area of the pressure decreasing means is the same as that in the case where the swash plate 15 is at the maximum inclined angle. With the swash plate at the minimum inclined angle, therefore, excellent lubrication is carried out in the compressor as in the fourth embodiment.

Figure 20:
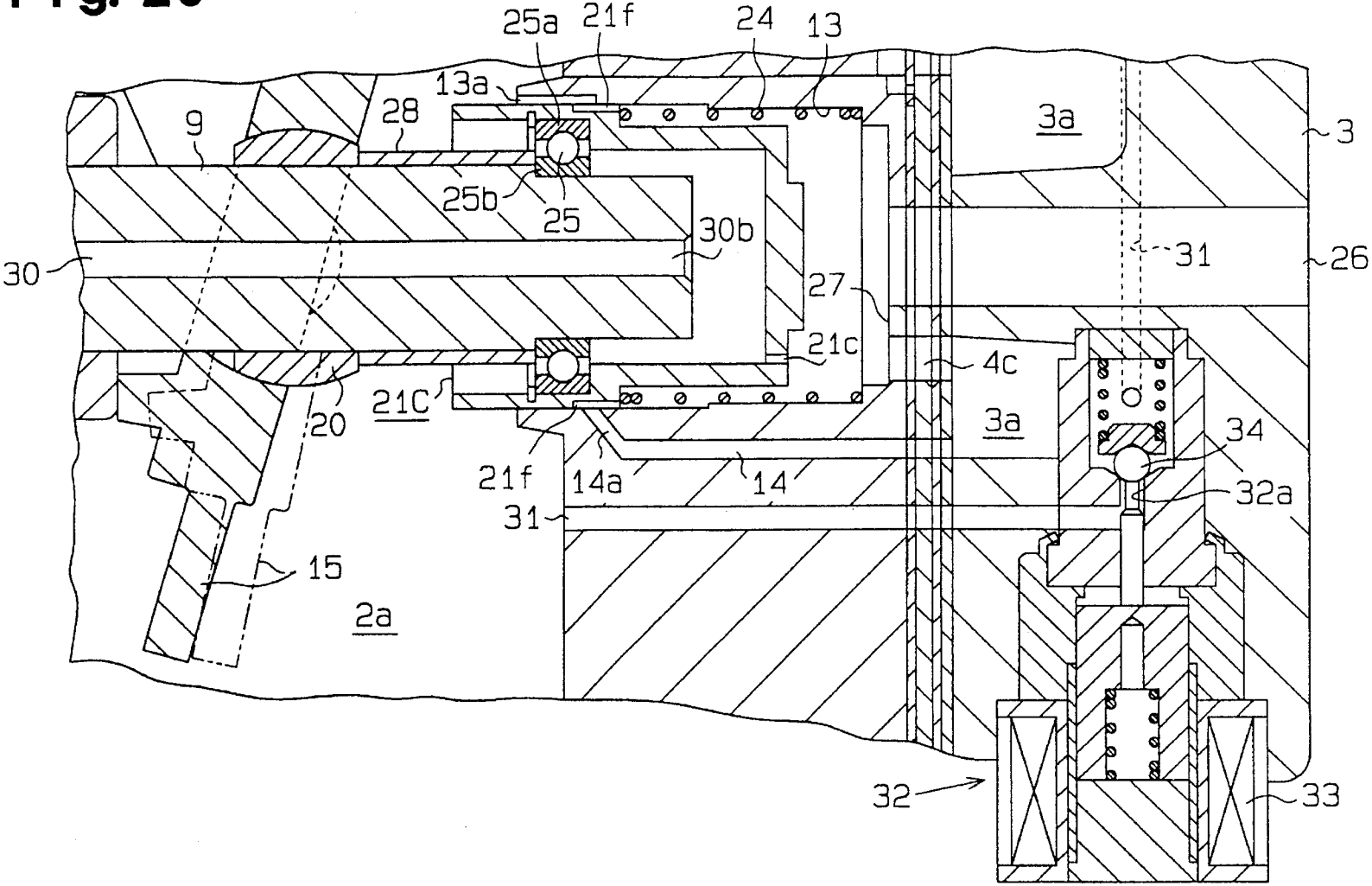
FIG. 20 is an enlarged cross-sectional view of a portion of the compressor of FIG. 18 with its swash plate at the maximum inclined angle according to the sixth embodiment of the present invention.
Figure 21:
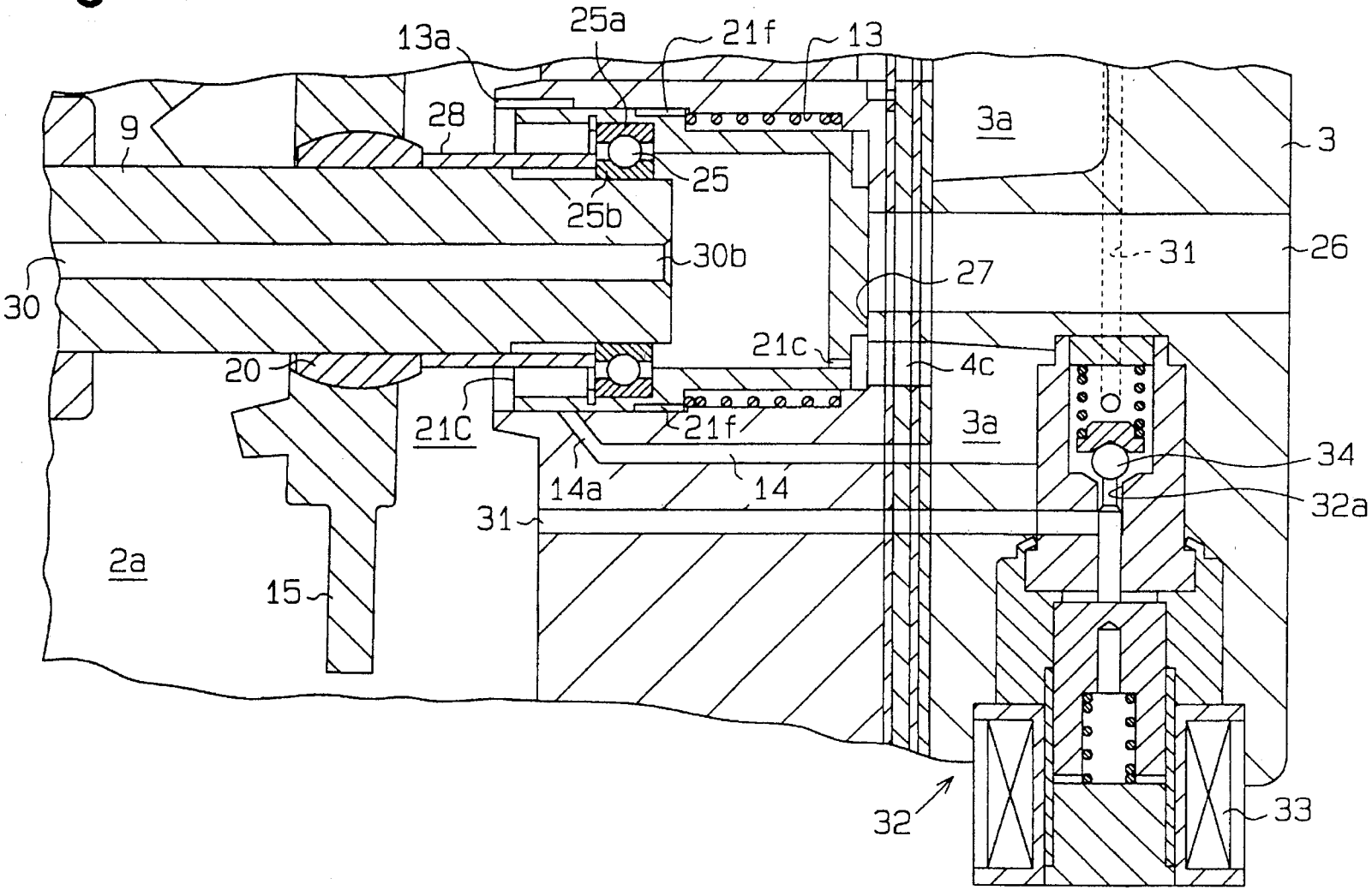
FIG. 21 is an enlarged cross-sectional view of a portion of the compressor of FIG. 20 with its swash plate at the minimum inclined angle.

A sixth embodiment of this invention will be described below with reference to FIGS. 20 and 21. In this embodiment, the members identical to those in the first embodiment are indicated by the same numerals and not explained.

In the sixth embodiment, a connector 20 having a spherical surface is supported on the drive shaft 9 in such a manner as to be slidable along the axis of the drive shaft 9. The swash plate is tiltably supported on the connector 20. A spool 21C is slidably retained in the shutter chamber 13. The pipe 28 is slidably attached to the drive shaft 9 between the connector 20 and the ball bearing 25. The front end of the pipe 28 is abuttable on the end face of the connector 20 and the rear end of the pipe 28 is abuttable on the inner race **25*b* of the ball bearing 25**.

When the inclined angle of the swash plate 15 becomes smaller, the connector 20 moves toward the spool 21C. This urges the pipe 28 against the inner race **25*b* of the ball bearing 25. Since the pipe 28 is held between the connector 20 and the inner race 25*b*, the pipe 28 rotates together with the drive shaft 9. The pipe 28 abuts only on the inner race 25*b* of the ball bearing 25, the drive shaft 9, the connector 20, the pipe 28 and the inner race 25*b*** rotate together and do not slide against one another.

A groove **13*a* linked to the crank chamber 2*a* is formed in the shutter chamber 13. The through hole 21*c* and a connection passage 21*f* are formed in the spool 21C. When the swash plate 15 is positioned near the maximum inclined angle, the connection passage 21*f* is connected to the groove 13*a*, as shown in FIG. 20. When the swash plate 15 is positioned in the range from the intermediate inclined angle indicated by the chain line in FIG. 20 to the minimum inclined angle shown in FIG. 21, the connection passage 21*f* is blocked from the groove 13*a*. The cross-sectional area of the pressure decreasing passage means from the crank chamber 2*a* to the suction chamber 3*a* therefore changes along the curve $E_1$ in the graph of FIG. 7 as discussed in the section of the first embodiment. Accordingly, the increase in torque during the movement of the swash plate 15** to the maximum inclined angle from the minimum inclined angle becomes gentle, and engine stall is avoided.

The present invention is not limited only to the embodiments disclosed herein, but may employ the structure disclosed in U.S. Pat. No. 5,173,032, which prevents the flow of the refrigerant gas into the suction chamber from the external refrigeration circuit by means of an electromagnetic valve.

What is claimed is:

1. A compressor comprising a swash plate mounted on a drive shaft for integral rotation therewith in a crank chamber and a piston coupled to the swash plate and disposed in a cylinder bore, wherein the rotation of the drive shaft is converted to a reciprocating movement of the piston to compress gas supplied to the cylinder bore from an external circuit by way of a suction chamber and to discharge the gas to a discharge chamber, said swash plate being tiltable between a maximum inclining angle and a minimum inclining angle with respect to the drive shaft according to the difference between pressures in the crank chamber and the suction chamber, and wherein said swash plate controls the displacement of the compressor to be maximum when the swash plate is at the maximum inclining angle and to be minimum when the swash plate is at the minimum inclining angle, said compressor further comprising:

means for disconnecting the external circuit with the suction chamber when the swash plate is at the minimum inclining angle;

a pressure decreasing passage means connecting the crank chamber and the suction chamber for decreasing the pressure in the crank chamber, said passage means releasing the pressure in the crank chamber to the suction chamber when the pressure in the crank chamber is greater than the pressure in the suction chamber, whereby the swash plate is inclined toward the maximum inclining angle; and means for adjusting the flow in the pressure decreasing passage means, such that the pressure decreasing passage means is opened to a greater degree when the swash plate is at the maximum inclining angle than when the swash plate is between the maximum and minimum inclining angles.

2. The compressor as set forth in claim 1, wherein said adjusting means opens the pressure decreasing passage means to a greater degree when the swash plate is at the minimum inclining angle than when the swash plate is between the maximum and minimum inclining angles.

3. The compressor as set forth in claim 2, wherein the adjusting means comprises a variable flow controlling passage, and wherein the adjusting means opens the variable flow controlling passage when the swash plate is at the maximum and minimum inclining angles.

4. The compressor as set forth in claim 1, wherein said disconnecting means includes:

a suction passage for connecting the suction chamber with the external circuit;

a spool movable along the axis of the drive shaft, said spool having an end surface for closing the suction passage and disconnecting the suction chamber from the external circuit when the swash plate is at the minimum inclining angle.

5. The compressor as set forth in claim 4 further comprising:

an accommodating chamber for slidably accommodating the spool, said accommodating chamber being selectively connected and disconnected with the suction passage by the end surface of the spool; and a communicating passage for permanently connecting the suction chamber with the accommodating chamber.

6. The compressor as set forth in claim 4 wherein said spool has a hollow cylindrical shape, and wherein a bearing is disposed within the spool to rotatably support the drive shaft.

7. The compressor as set forth in claim 6, further comprising an actuating member movable along the drive shaft for transmitting the inclining motion of the swash plate to the spool by way of said bearing.

8. The compressor as set forth in claim 7, further comprising:

a supply passage connecting the discharge chamber with the crank chamber to supply the gas to the crank chamber from the discharge chamber; and a circulating passage means including the pressure decreasing passage means and the supply passage, said circulating passage means being selectively opened and closed.

9. The compressor as set forth in claim 1, wherein the pressure decreasing passage means comprises a variable flow controlling passage, and wherein the adjusting means adjusts the variable flow controlling passage in accordance with the position of the swash plate.

10. The compressor as set forth in claim 1, further comprising a spool movable along the axis of the drive shaft, the spool having a circumferential surface, wherein the pressure decreasing passage means includes a fixed flow controlling passage permanently connecting the crank chamber with the suction chamber and a variable flow controlling passage selectively opened and closed by the circumferential surface of the spool, wherein the variable flow controlling passage is opened for connecting and closed for disconnecting the crank chamber to the suction chamber, the circumferential surface of the spool opening the variable flow controlling passage when the swash plate is at the maximum inclining angle and closing the variable flow controlling passage when the swash plate is between the maximum and minimum inclining angles.

11. A compressor comprising a swash plate mounted on a drive shaft for integral rotation therewith in a crank chamber and a piston coupled to the swash plate and disposed in a cylinder bore, wherein the rotation of the drive shaft is converted to a reciprocating movement of the piston to compress gas supplied to the cylinder bore from an external circuit by way of a suction chamber and to discharge the gas to a discharge chamber, said swash plate being tiltable between a maximum inclining angle and a minimum inclining angle with respect to the drive shaft according to the difference between pressure in the crank chamber and the suction chamber to control a displacement of the compressor, a supply passage for connecting the discharge chamber with the crank chamber, said supply passage being selectively opened and closed in accordance with an operational status of the compressor, wherein said swash plate is inclined toward the minimum inclining angle by the pressure supplied to the crank chamber from the discharge chamber when the supply passage is opened and the swash plate is inclined toward the maximum inclining angle when the supply passage is closed; said compressor further comprising:

means for disconnecting the external circuit with the suction chamber when the swash plate is at the minimum inclining angle;

a valve for selectively opening and closing the supply passage in accordance with the operational status of the compressor;

a pressure decreasing passage means connecting the crank chamber and the suction chamber for decreasing the pressure in the crank chamber, said pressure decreasing passage means being arranged to release the pressure in the crank chamber to the suction chamber when the pressure in the crank chamber is greater than the pressure in the suction chamber, whereby the swash plate is inclined toward the maximum inclining angle; and means for adjusting the flow in the pressure decreasing passage means, such that the pressure decreasing passage means is opened to a greater degree when the swash plate is at the maximum inclining angle than when the swash plate is between the maximum and minimum inclining angles.

12. The compressor as set forth in claim 11, wherein said adjusting means opens the pressure decreasing passage means to a greater degree when the swash plate is at the minimum inclining angle than when the swash plate is between the maximum and minimum inclining angles.

13. The compressor as set forth in claim 11, wherein said valve comprises an electromagnetic valve.

14. The compressor as set forth in claim 13, wherein said electromagnetic valve closes the supply passage when the valve is energized and opens the supply passage when the valve is deenergized.

15. The compressor as set forth in claim 14 further comprising a computer for controlling the electromagnetic valve with a plurality of signals indicative of the operational status of the compressor.

16. A compressor comprising a swash plate mounted on a drive shaft for integral rotation therewith in a crank chamber and a piston coupled to the swash plate and disposed in a cylinder bore, wherein the rotation of the drive shaft is converted to a reciprocating movement of the piston to compress gas supplied to the cylinder bore from an external circuit by way of a suction chamber and to discharge the gas to a discharge chamber, said swash plate being tiltable between a maximum inclining angle and a minimum inclining angle with respect to the drive shaft according to the difference between pressures in the crank chamber and the suction chamber, and wherein said swash plate controls the displacement of the compressor to be maximum when the swash plate is at the maximum inclining angle and to be minimum when the swash plate is at the minimum inclining angle, said compressor further comprising:

means for disconnecting the external circuit with the suction chamber when the swash plate is at the minimum inclining angle;

a pressure decreasing passage means connecting the crank chamber and the suction chamber for decreasing the pressure in the crank chamber, said pressure decreasing passage means being arranged to release the pressure in the crank chamber to the suction chamber when the pressure in the crank chamber is greater than the pressure in the suction chamber, whereby the swash plate is inclined toward the maximum inclining angle;

a gas supply passage connecting the discharge chamber with the crank chamber;

a valve for selectively opening and closing the supply passage, wherein the swash plate is inclined toward the minimum inclining angle when the supply passage is opened, and wherein the swash plate is inclined toward the maximum inclining angle when the supply passage is closed;

a circulating passage means including the pressure decreasing passage means and the supply passage, said circulating passage being selectively opened and closed such that gas circulates in the circulating passage at selected times; and means for adjusting the flow in the pressure decreasing passage means, wherein the pressure decreasing passage means is opened to a greater degree when the swash plate is at the maximum inclining angle than when the swash plate is between the maximum and minimum inclining angles.

17. The compressor as set forth in claim 16, wherein said adjusting means opens the pressure decreasing passage means to a greater degree when the swash plate is at the minimum inclining angle than when the swash plate is between the maximum and minimum inclining angles.

18. The compressor as set forth in claim 16, wherein said disconnecting means includes:

a suction passage for connecting the suction chamber with the external circuit;

a spool movable along the axis of the drive shaft, said spool having an end surface for closing the suction passage and disconnecting the suction chamber from the external circuit when the swash plate is at the minimum inclining angle.

19. The compressor as set forth in claim 18, wherein the spool has a circumferential surface, the pressure decreasing passage means comprises a fixed flow controlling passage permanently connecting the crank chamber with the suction chamber and a variable flow controlling passage selectively opened and closed by the circumferential surface of the spool, and the variable flow controlling passage is opened for connecting and closed for disconnecting the crank chamber to the suction chamber such that the circumferential surface of the spool opens the variable flow controlling passage when the swash plate is at the maximum inclining angle and closes the variable flow controlling passage when the swash plate is between the maximum and minimum inclining angles.

* * * * *

UNITED STATES PATENT AND TRADEMARK OFFICE

CERTIFICATE OF CORRECTION

PATENT NO. : 5,584,670

DATED : December 17, 1996

INVENTOR(S) : Kawaguchi et al

It is certified that error appears in the above-indentified patent and that said Letters Patent is hereby corrected as shown below:

Column 1, line 61, after "then" insert --supplied--.

Column 4, line 7, after "second" insert --embodiment--.

Column 5, line 9, before "support" insert --the--.

Column 7, line 3, after "passage" insert comma --,--.

Column 7, at line 40 insert --Thus, the axial passage 30, the connection passage 21d, the through hole 21c, the communication hole 4c, and the variable flow controlling passage 14 together serve as a pressure decreasing passage means connecting the crank chamber 2a, to the suction chamber 3a, and thus the cross-sectional area of a restricted portion of this pressure decreasing passage means changes in accordance with the inclined angle of the swash plate 15.--

Column 9, line 33, after "3a" insert --via the--.

Column 10, line 35, after "gas" insert --passing--.

UNITED STATES PATENT AND TRADEMARK OFFICE

CERTIFICATE OF CORRECTION

PATENT NO. : 5,584,670

DATED : December 17, 1996

INVENTOR(S) : Kawaguchi et al

It is certified that error appears in the above-indentified patent and that said Letters Patent is hereby corrected as shown below:

Column 11, line 24, after "decreasing" insert --passage--.

Column 12, line 33, "Available" should read --A variable--; line 58 after "is" insert --at--.

Column 15, line 3, after "decreasing" insert --passage--.

Column 17, line 28, "pressure" should read --pressures--.

Signed and Sealed this

Seventeenth Day of June, 1997

Bruce Lehman

*Attest:*

BRUCE LEHMAN

*Attesting Officer*

*Commissioner of Patents and Trademarks*